US005792971A

United States Patent [19]

Timis et al.

[11] Patent Number: 5,792,971

[45] Date of Patent: Aug. 11, 1998

[54] METHOD AND SYSTEM FOR EDITING DIGITAL AUDIO INFORMATION WITH MUSIC-LIKE PARAMETERS

[75] Inventors: Dan Timis, Mountain View; David Gerard Willenbrink, San Francisco, both of Calif.

[73] Assignee: Opcode Systems, Inc., Palo Alto, Calif.

[21] Appl. No.: 715,529

[22] Filed: Sep. 18, 1996

[51] Int. Cl.[6] ..... G10H 7/00; G10H 7/10

[52] U.S. Cl. ..... 84/609; 84/603; 84/604; 84/626; 364/192; 369/83

[58] Field of Search ..... 84/601–606, 609–613, 84/626–637, 645; 364/192; 369/83, 84; 395/2.87

[56] References Cited

U.S. PATENT DOCUMENTS 5,204,969 4/1993 Capps et al. ..... 395/800

5,567,901 10/1996 Gibson et al. ..... 84/603

5,602,356 2/1997 Mohrbacher ..... 84/609

*Primary Examiner*—William M. Shoop, Jr.

*Assistant Examiner*—Marlon T. Fletcher

*Attorney, Agent, or Firm*—Townsend and Townsend and Crew LLP; Kenneth R. Allen

[57] ABSTRACT

The present invention provides a method for editing digital audio information, such as musical material. Original musical parameters (302) are extracted and/or inputted from recorded original digital audio material (300). The original musical parameters (302) are then edited. The resulting edited musical parameters (304) are compared to the original musical parameters (302) to provide time varying control functions (308, 310, 312). The original digital audio material (300) is then processed with signal processing algorithms (314, 316, 318) which are controlled by the time varying control functions (308, 310, 312). This processing changes the original digital audio material (300) into new digital audio material (320) having musical characteristics which correspond to the edited musical parameters (304).

35 Claims, 16 Drawing Sheets

Music Notation
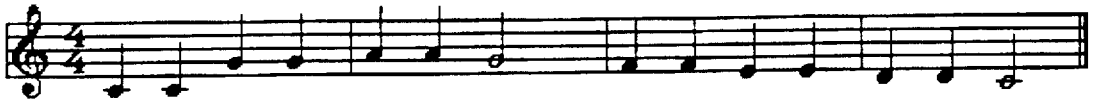
Figure 4a
Piano Roll
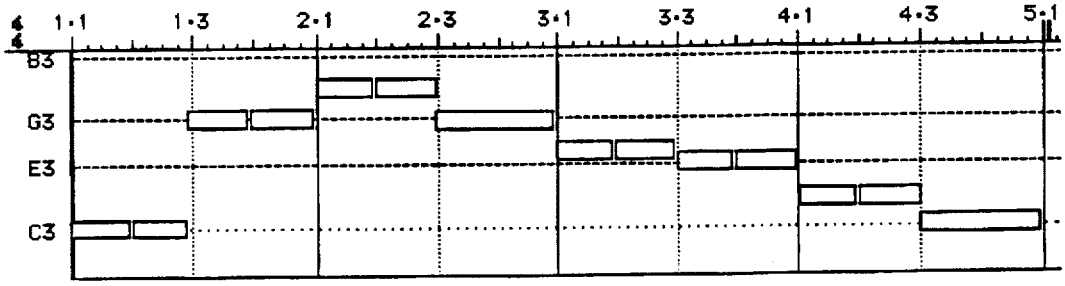
Figure 4b
List View
| | Bar | Beat | Unit | Note | Duration Qtrs | Units | Velocity | |
|---|---|---|---|---|---|---|---|---|
| • | 1 | 1 | 0 | C3 | 1 | 0 | 64↓ | 64↑ |
| • | 1 | 2 | 0 | C3 | 1 | 0 | 64↓ | 64↑ |
| • | 1 | 3 | 0 | G3 | 1 | 0 | 64↓ | 64↑ |
| • | 1 | 4 | 0 | G3 | 1 | 0 | 64↓ | 64↑ |
| • | 2 | 1 | 0 | A3 | 1 | 0 | 64↓ | 64↑ |
| • | 2 | 2 | 0 | A3 | 1 | 0 | 64↓ | 64↑ |
| • | 2 | 3 | 0 | G3 | 2 | 0 | 64↓ | 64↑ |
| • | 3 | 1 | 0 | F3 | 1 | 0 | 64↓ | 64↑ |
| • | 3 | 2 | 0 | F3 | 1 | 0 | 64↓ | 64↑ |
| • | 3 | 3 | 0 | E3 | 1 | 0 | 64↓ | 64↑ |
| • | 3 | 4 | 0 | E3 | 1 | 0 | 64↓ | 64↑ |
| • | 4 | 1 | 0 | D3 | 1 | 0 | 64↓ | 64↑ |
| • | 4 | 2 | 0 | D3 | 1 | 0 | 64↓ | 64↑ |
| • | 4 | 3 | 0 | C3 | 2 | 0 | 64↓ | 64↑ |
Figure 4c Text
| | | | |
|---|---|---|---|
| Bar 1 | Beat 1 | C3 | Quarter |
| | Beat 2 | C3 | Quarter |
| | Beat 3 | G3 | Quarter |
| | Beat 4 | G3 | Quarter |
| Bar 2 | Beat 1 | A3 | Quarter |
| | Beat 2 | A3 | Quarter |
| | Beat 3 | G3 | Half |
| Bar 3 | Beat 1 | F3 | Quarter |
| | Beat 2 | F3 | Quarter |
| | Beat 3 | E3 | Quarter |
| | Beat 4 | E3 | Quarter |
| Bar 4 | Beat 1 | D3 | Quarter |
| | Beat 2 | D3 | Quarter |
| | Beat 3 | C3 | Half |
Figure 4d
Controller View, Volume
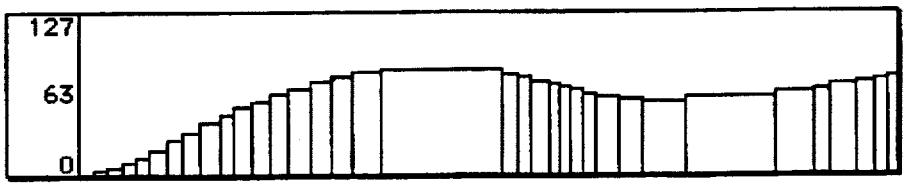
Figure 4e
Controller View, Pitch Bend
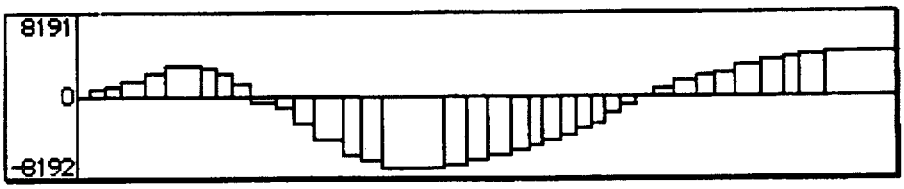
Figure 4f Waveform Display Sonogram Display

METHOD AND SYSTEM FOR EDITING DIGITAL AUDIO INFORMATION WITH MUSIC-LIKE PARAMETERS

CROSS REFERENCE TO RELATED APPLICATION

This application is a continuation-in-part of copending U.S. patent application Ser. No. 60/004,649 filed as a provisional application Sep. 29, 1995 in the names of Dan Timis and David Gerard Willenbrink under the title SYSTEM FOR EDITING DIGITAL AUDIO MATERIAL WITH MUSICAL PARAMETERS. This application claims priority from the prior provisional application.

COPYRIGHT NOTICE

A portion of the disclosure of this patent document contains material which is subject to copyright protection. The copyright owner has no objection to the photographic reproduction by anyone of the patent document or the patent disclosure in exactly the form it appears in the Patent and Trademark Office patent file or records, but otherwise reserves all copyright rights whatsoever.

BACKGROUND OF THE INVENTION

The present invention is directed to a system for editing recorded and synthesized music, and more particularly to a computer program for transforming musically significant parameters of digital audio data.

Music is often recorded, produced and distributed as digital audio data. Analog audio signals from microphones, electric guitars, or other electronic instruments are converted into a series of digital samples that represent the instantaneous amplitude of the audio waveform. The digital signals are often immediately processed with digital reverberation, equalization and other transformations. Recorded samples can be stored on multi-track digital audio tape machines and computer mass storage systems. Separate digital files for vocals and instruments can be further processed and digitally mixed into a final master. The digital master can then be used to produce compact discs and other digital distribution media as well as analog distribution media such as audio cassettes. Compact discs (CDs) contain 16-bit samples that are sampled at the rate of 44.1 kHz.

Personal computers play an increasingly important part in the creation of synthesized sounds and their arrangement into music. Specialized personal computer software called sequencers allow music to be composed in standard or special musical notation and played by sending sequences of signals to sound-producing equipment such as synthesizers. The Musical Instrument Digital Interface (MIDI) standard specifies the communications protocol that is used between devices that control performances (such as keyboards and sequencers), devices that produce sounds (such as synthesizers), and devices that record and play back performances (such as digital audio tape recorders). The product Vision, commercially available for several years from the present patent application's assignee Opcode Systems, Inc., is a popular sequencer program for personal computers.

Personal computers are also used to provide flexible editing of digital audio material. Multi-track recordings can be loaded onto the hard disk of a personal computer or directly recorded to the hard disk. Special software allows the playback of previously recorded tracks while additional tracks are recorded in a process known as overdubbing. Individual tracks or the finished material can be processed with special effects, equalized and mixed. Cut, copy and paste operations can be used to produce a composite performance from a series of partial recordings with very high accuracy. Repetitive patterns such as drum rhythms can be automatically repeated.

Note sequences for synthesizers are often represented on the computer's monitor in piano roll format, where the X-axis represents time and the Y-axis represents the pitch of a note. (See FIG. 4*b*.) The length of a note in piano roll format represents its duration. Conventional music notation can also be used to represent sequences. (See FIG. 4*a*.) List windows represent musical parameters in numerical form allowing for very detailed editing. (See FIG. 4*c*.)

Digital editing programs usually represent sounds as waveforms, showing the instantaneous amplitude of the signal on a Y-axis with time on the X-axis. (See FIG. 5*a*.) This form of representation often shows the shapes of phrases and sometimes of individual notes especially with percussive sounds. However, editing on a note by note basis is not always easy, particularly for vocals and wind instruments.

The early versions of the product Studio Vision Pro (Version 1.4 and Version 2.0 (both introduced before October 1994), also available from Opcode Systems, Inc., were the first commercial products to combine a MIDI sequencer with an editor for digital audio recordings. In this and competitive products, some tracks represent synthesized sounds (e.g., for drums and accompaniment), while other tracks on the screen show at the same time digital audio for other sounds in the same piece, such as vocals and solo instruments.

The professional recording and production of music is often a time-consuming and expensive process. The staff of a recording studio often records the same piece over and over until a perfect "take" is achieved. If there is one wrong note, an extraneous sound, a timing problem, a lack of synchronization with previously recorded tracks in a long song, or the like, it has often been necessary to abandon the entire take and start over. Dozens of "takes" are not uncommon, and a sizable well paid staff of musicians, recording engineers and producers is often involved. The significant capital equipment in a studio is also engaged during long recording sessions. The necessity for multiple "takes" accounts for a significant fraction of the costs of music recording.

Music production usually includes two distinct phases: recording and mixing. During recording, artists usually listen to previously recorded tracks played as performed and add additional "raw" tracks. The result is a multi-track recording. After the recording sessions are over and the artists have dispersed, a smaller staff often enhances the recorded material in a variety of ways and mixes the multiple tracks into two stereo tracks for duplication. Flaws in recorded material and new musical opportunities are often discovered during this production stage, when the original artists are usually no longer available.

By contrast, sequencer music is stored in a form that is easily editable and precisely reproducible. A variety of significant parameters are stored for every note. Live performances on keyboards and other MIDI controllers can be captured for later editing. Music can also be composed slowly, note by note and phrase by phrase and later edited to play at a designated tempo. Individual musical notes can be easily dragged on the screen to different pitches or durations and they can be assigned to different instruments. Defects in a take can be easily corrected and new musical ideas explored after the original recording.

The ease and flexibility of sequencers has had an enormous impact on the production of popular music, allowing individual composers and performers to produce complex and rich music working alone. Synthetic music, however, cannot always reproduce the nuances, complex timbres and ambiance of real instruments and cannot produce vocals at all. Accordingly, much music is still recorded in studios, with the producers selecting the best of many takes.

Musicians, recording engineers, and producers wish they could modify digital audio recordings with the same ease and flexibility only a MIDI sequencer can offer. The ability to rectify the pitch of only a few notes, to change durations, tempo, volume, and other significant musical parameters within a digital audio recording could significantly reduce the number of takes in a multi-track recording session. Many minor mistakes could be corrected and new musical ideas explored without requiring the presence of the original recording artists. Additionally, new musical effects previously impossible to produce could be available.

Changing the pitch of audio, modifying timing without altering the pitch, changing volume and filtering, are well understood digital signal processing techniques available in a few commercial programs. Two of the companies that have products offering time compression/expansion and pitch shifting are EMAGIC with the program "Logic Audio" and Steinberg with the application "Time Bandit." However, most often these features are applied globally on entire digital audio files or events. When it's desirable to change only a single note, finding that note and specifying all the parameters needed to be changed is a very tedious process.

Apart from allowing many musical parameters to be changed, sequencer programs offer musicians a familiar editing environment. Changing pitches and durations in a traditional notation representation, in a piano roll, or in a list window is a friendly and very intuitive process. By contrast, editing a waveform representation of digital audio is a rather difficult task. Apart from a few cases of percussive sounds, selecting a note from a stream of samples is a long and difficult process that involves a lot of trial-and-error iterations.

Allowing digital audio to be represented in a form that is more familiar to the musician is a first step toward the goal of allowing digital recordings to be modified with the same ease as MIDI. A few commercially available computer programs or hardware devices (e.g., Pitch to MIDI converters) offer the possibility to turn audio into MIDI information including note numbers, note on/off, volume, and pitch bend information. Among software products for personal computers, the program "Logic Audio" from EMAGIC offers "Audio to Score," a feature that turns digital audio into musical notes. Another computer product that converts sound into MIDI is "Autoscore" from Wildcat Canyon Software.

Once digital audio information is represented in a musically significant manner, edits can be made to this representation in the familiar environments of traditional notation, piano roll, list window, or others. These changes can be automatically translated into parameters for Digital Signal Processing functions. By contrast, entering these parameters directly is a very tedious and non-intuitive process. These parameters can then be used to control digital signal processing (DSP) functions that will modify the recorded digital audio information resulting in new material that combines sonic qualities of the original audio with musically significant changes made through the MIDI representation. Thus, the desiderata of editing digital audio with the ease of use of MIDI is achieved.

SUMMARY OF THE INVENTION

The present invention provides a method for editing digital audio information with music-like characteristics based on comparison of a first set of control codes associated with the source program and a second set of control codes preselected to represent a desired editorial change. The present invention provides for transforming musically significant parameters of digital audio information. Thus, generalized musical notation represented by digital information is used to edit the musical characteristics of the source audio program information to produce an edited audio program.

In accordance with the invention, original musical parameters are input or extracted from recorded original digital audio information. In one embodiment, the original musical parameters are edited. In an alternative embodiment, additional musical parameters, such as codes representing additional voicing and instrumentation can be introduced. The resulting edited musical parameters are compared to the original musical parameters to provide time varying control functions. The original digital audio information is then processed with digital signal processing (DSP) algorithms, which are controlled by the time varying control functions. This processing changes the original digital audio information into new digital audio information having musical characteristics that correspond to the edited musical parameters.

The subject matter of this invention diclosure and the parent provisional patent application was first embodied in Studio Vision Pro Version 3.0 which was first commercially introduced in October 1995 by Opcode Systems, Inc. The present disclosure merely restates the subject matter of the parent provisional application.

The invention will be better understood upon reference to the following detailed description in conjunction with the accompanying drawings.

FIGS. *4a–4f* illustrate various forms of musical representation as may be seen by a user in an interactive display or printout.

FIGS. *5a–5c* show various forms of graphical representation of digital audio material as may be seen in an interactive display or printout.

Figure 6:
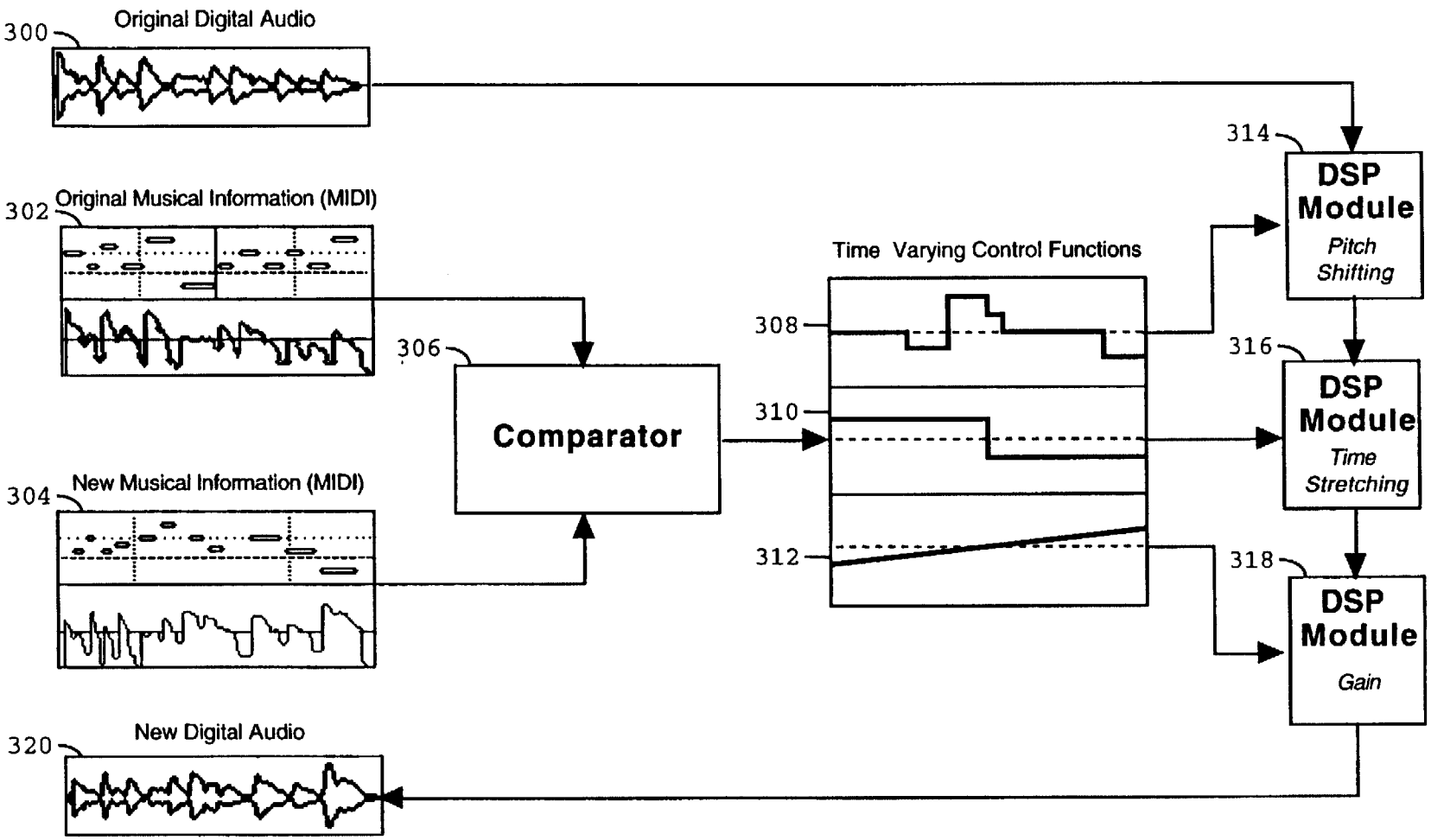

FIG. 6 is a block diagram showing the fundamental process of the present invention.

Figure 7:
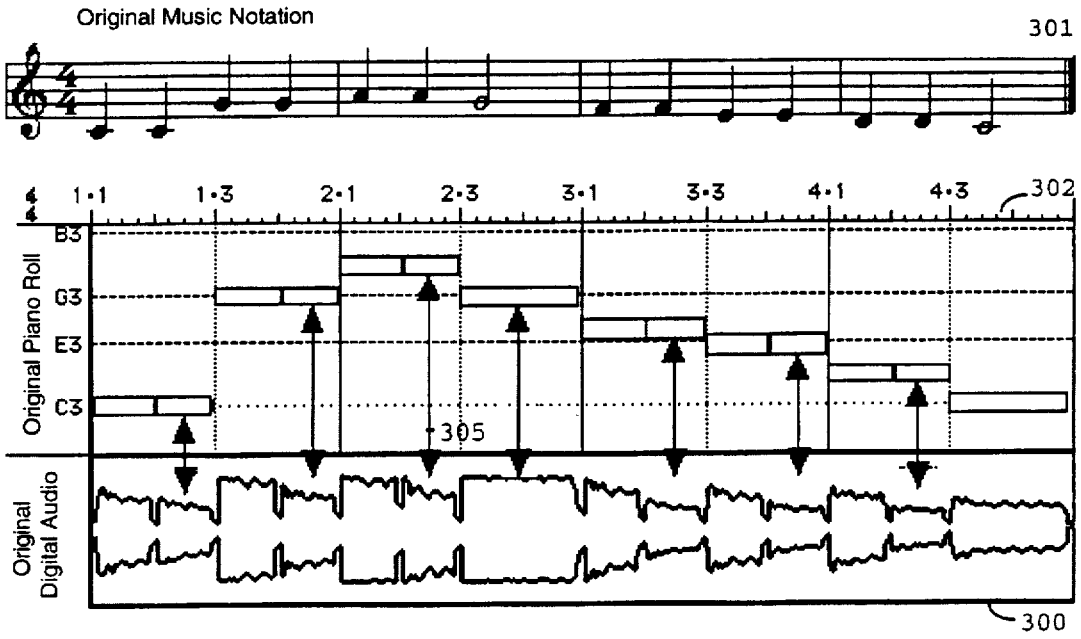

FIG. 7 is a time domain graph showing an original digital audio waveform for a musical passage along with the waveform's corresponding representation in musical notation and piano roll format.

Figure 8:
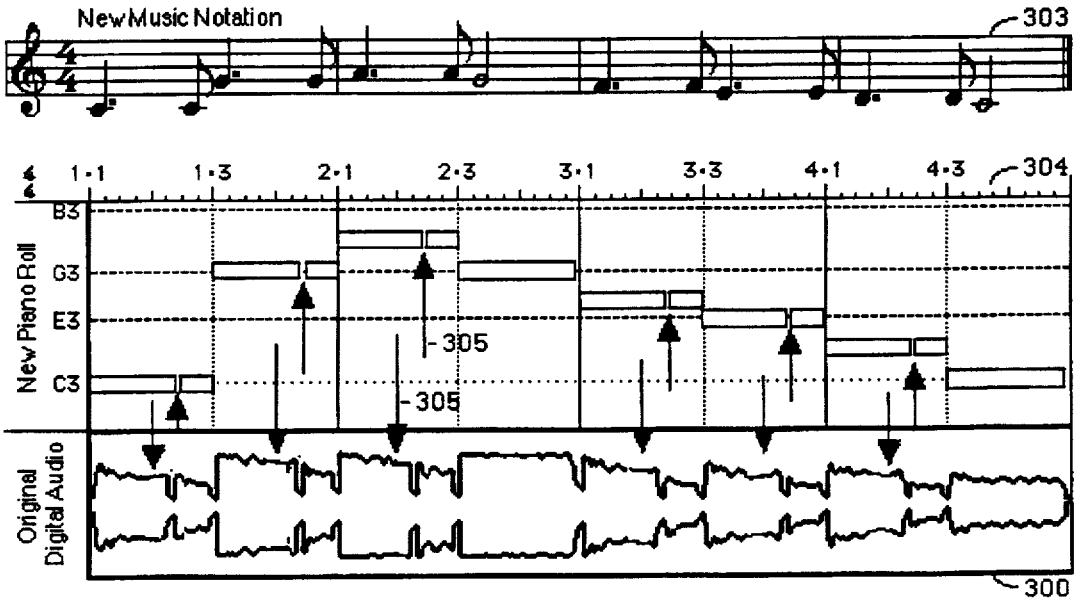

FIG. 8 is a time domain graph showing an original digital audio waveform for a musical passage along with an edited representation in musical notation and piano roll format.

Figure 9:
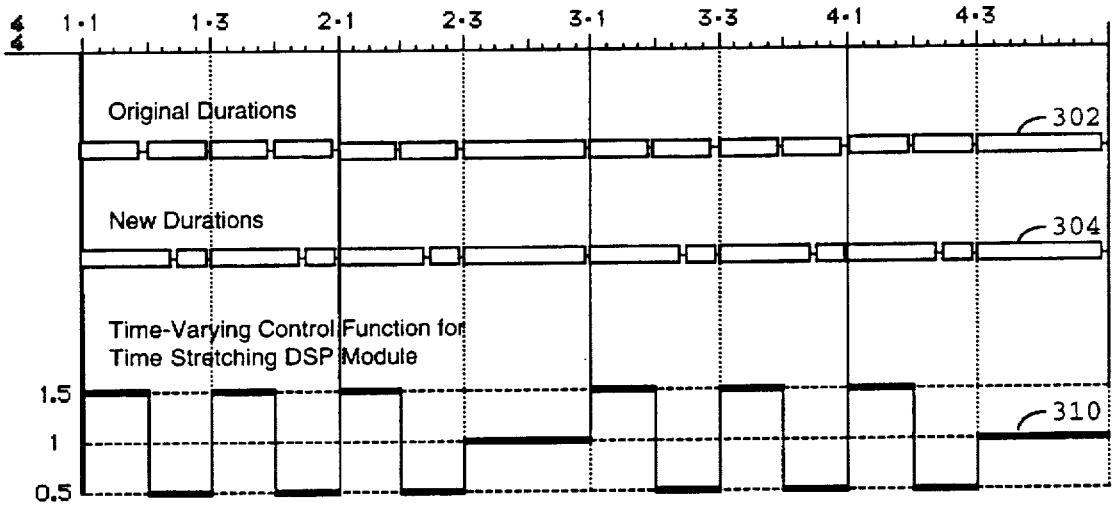

FIG. 9 is a time domain graph showing a time varying control function for time stretching along with representations in the original piano roll format and the edited piano roll format.

Figure 10:
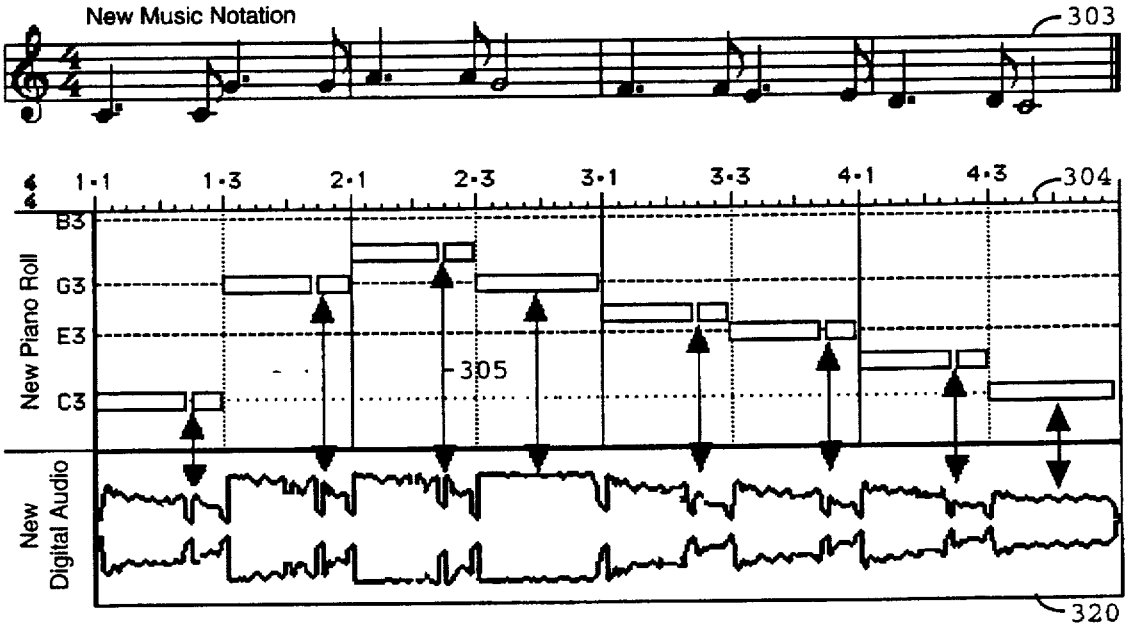

FIG. 10 is a time domain graph showing a new digital audio waveform for a musical passage along with the waveform's corresponding representation in musical notation and piano roll format based on an edited control function.

Figure 11:
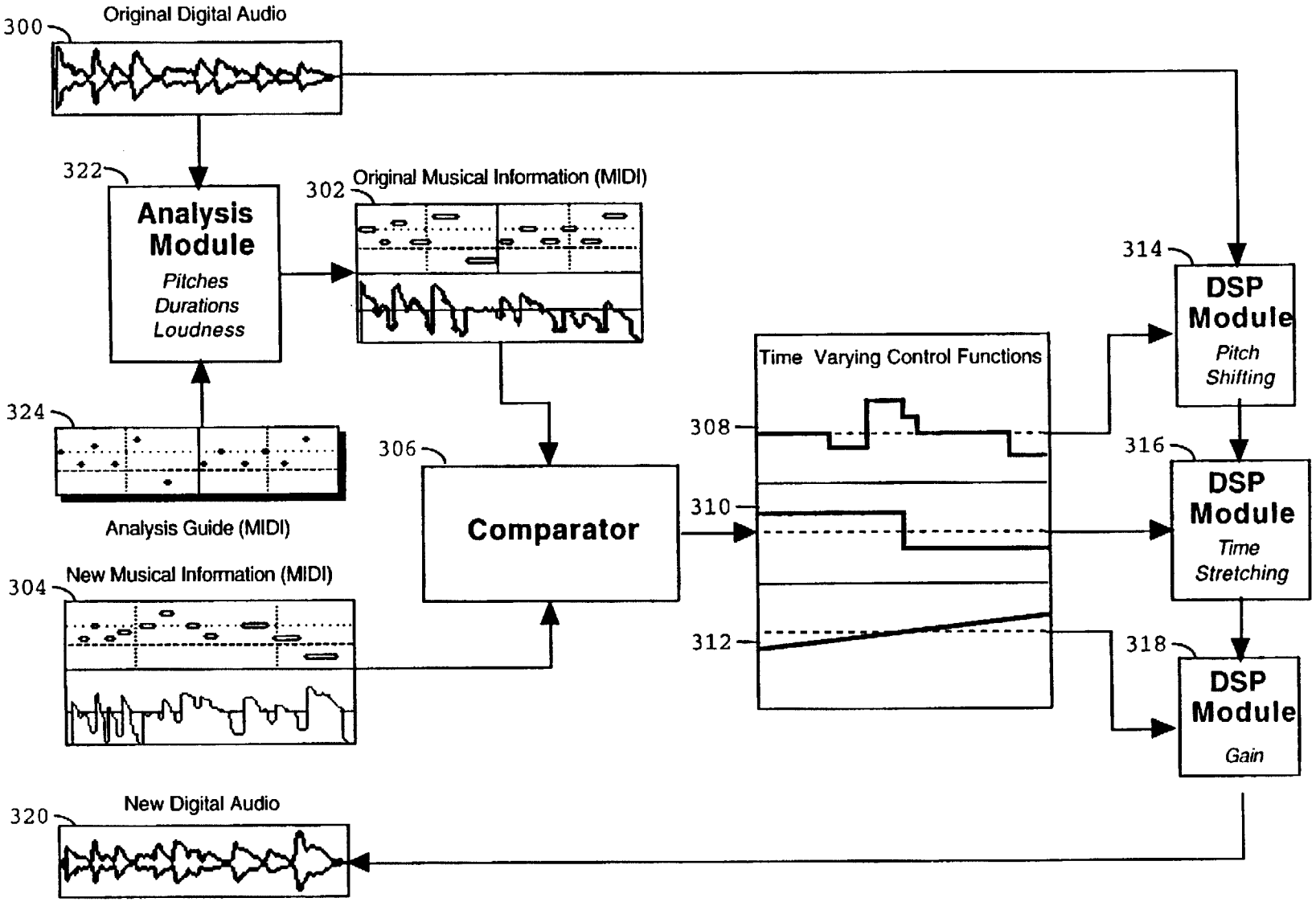

FIG. 11 is a block diagram showing the process of extracting musical parameters from source digital audio information using DSP analysis functions guided by analysis control functions.

Figure 12:
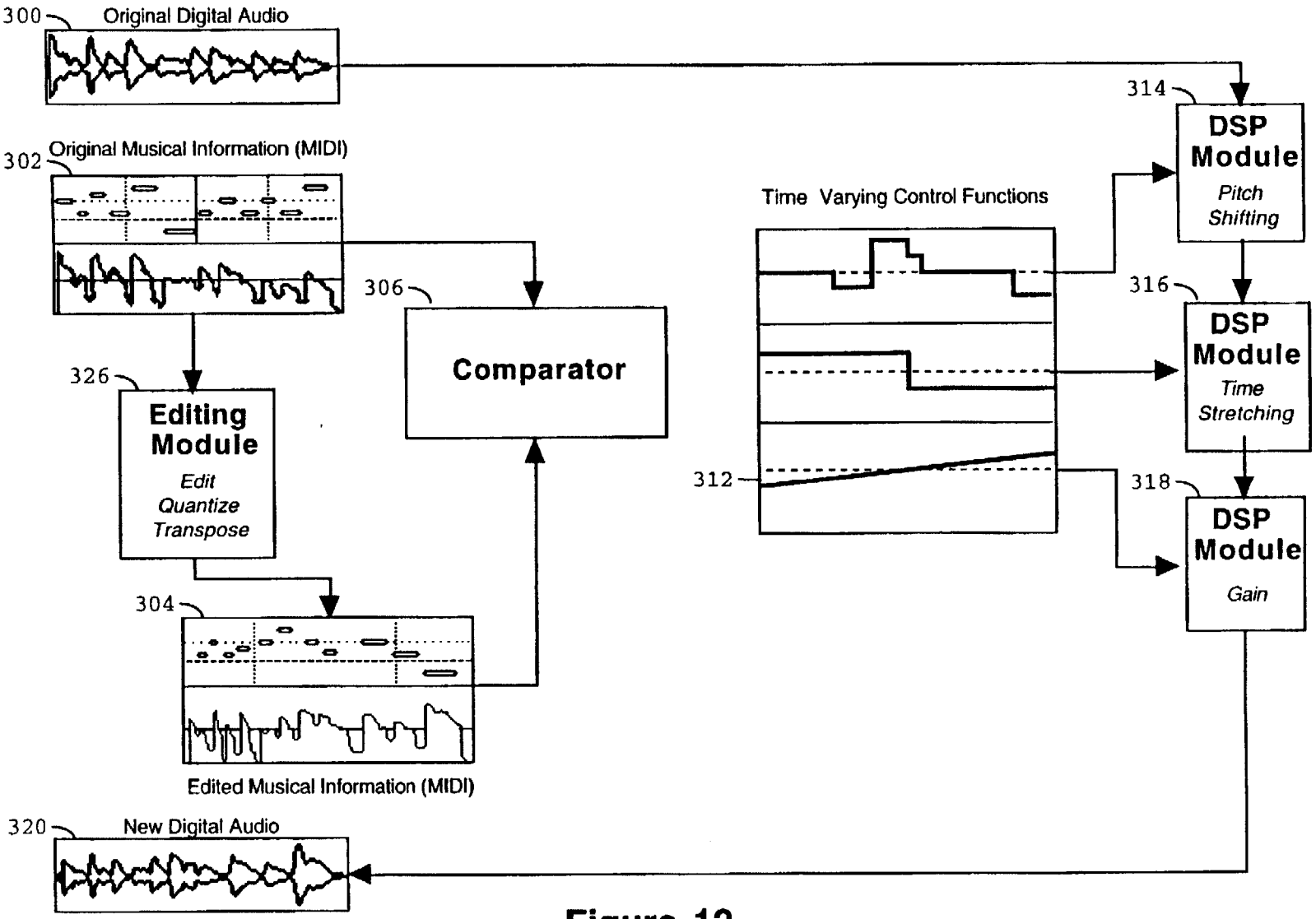

FIG. 12 is a block diagram showing the process of editing control parameters for digital audio information.

Figure 13:
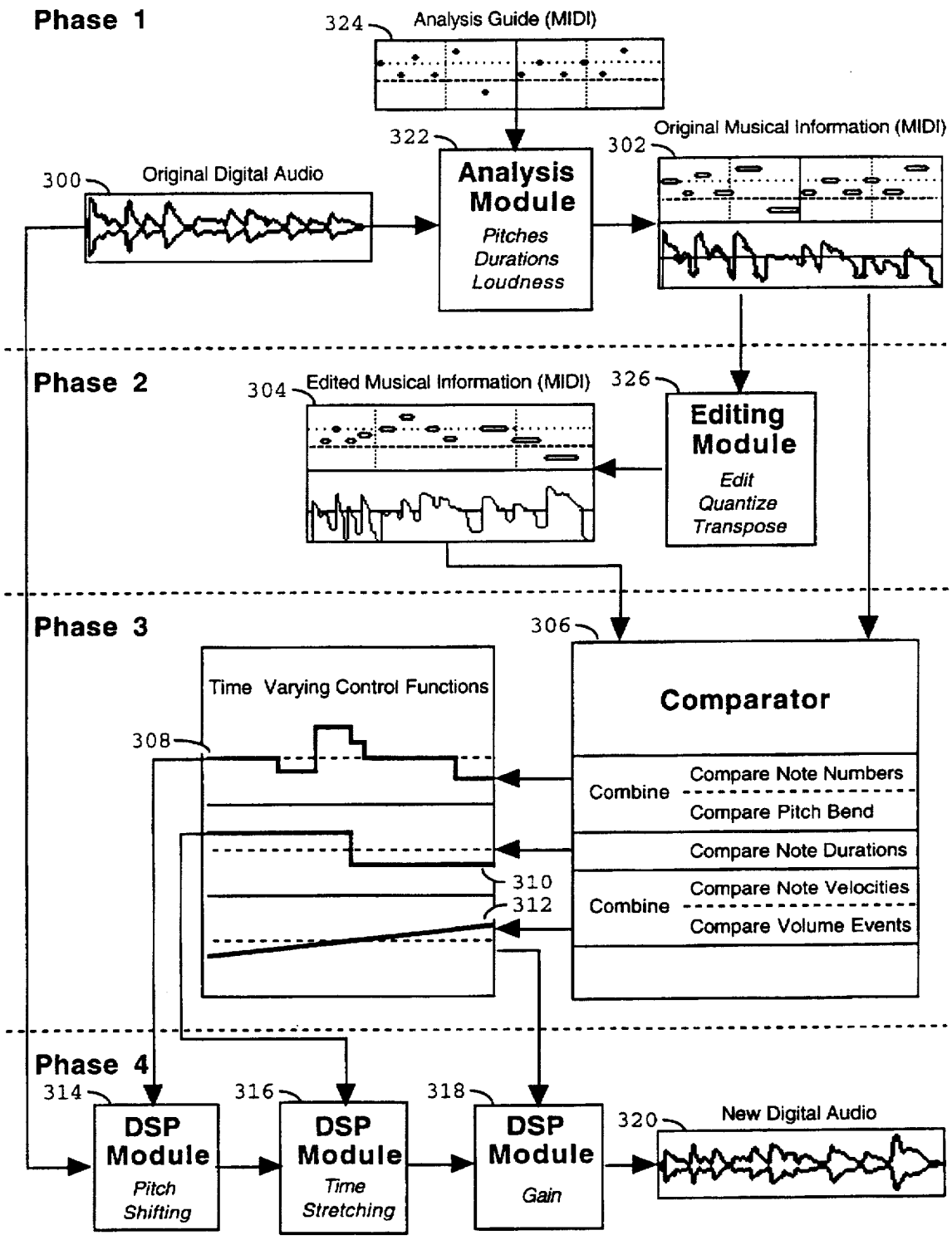
Figure 14:
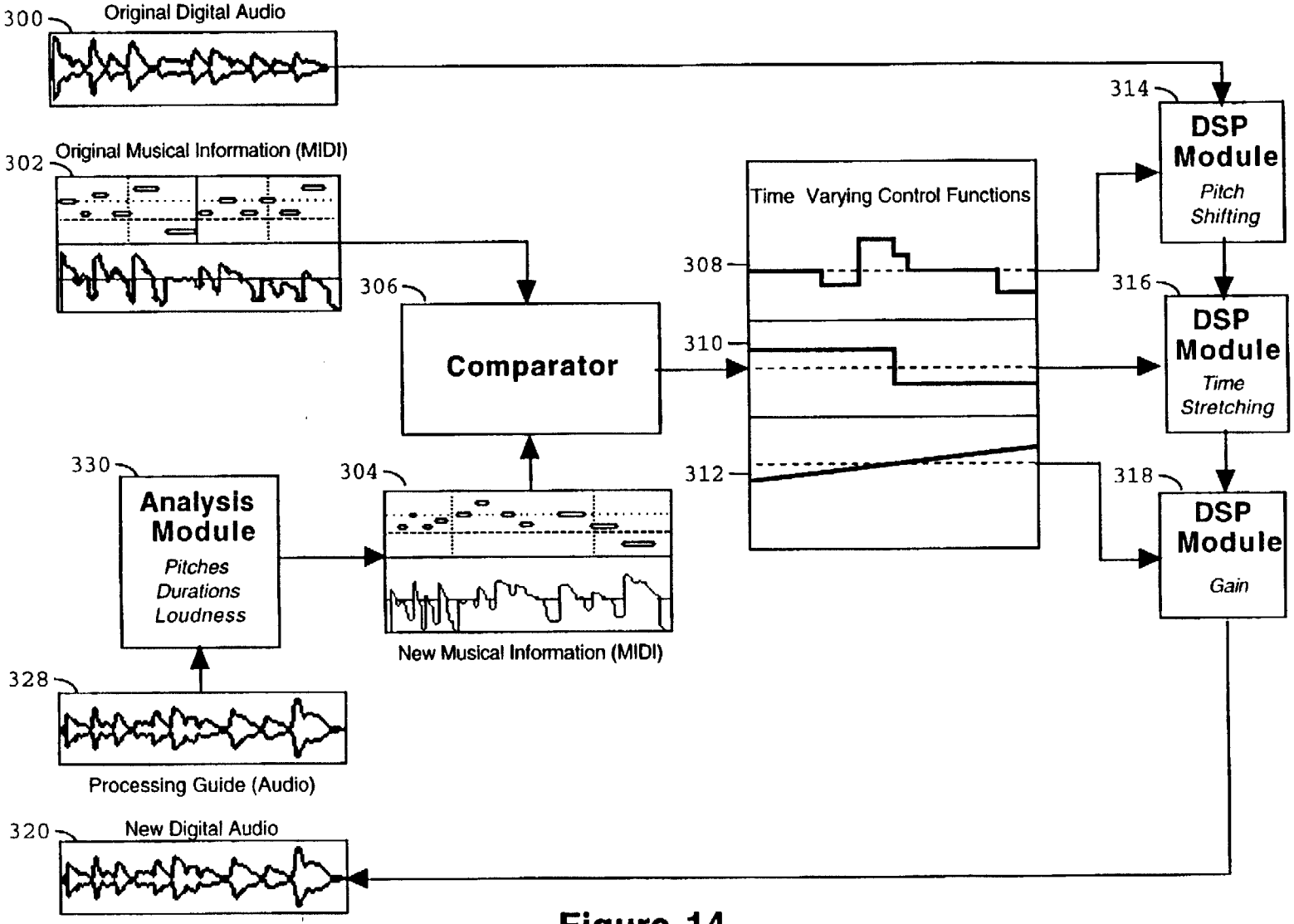

FIG. 13 is a block diagram illustrating the four phase process of one embodiment of the present invention;

FIG. 14 is a block diagram showing the process of extracting musical parameters from an external model of digital audio information using DSP analysis functions.

Figure 15:
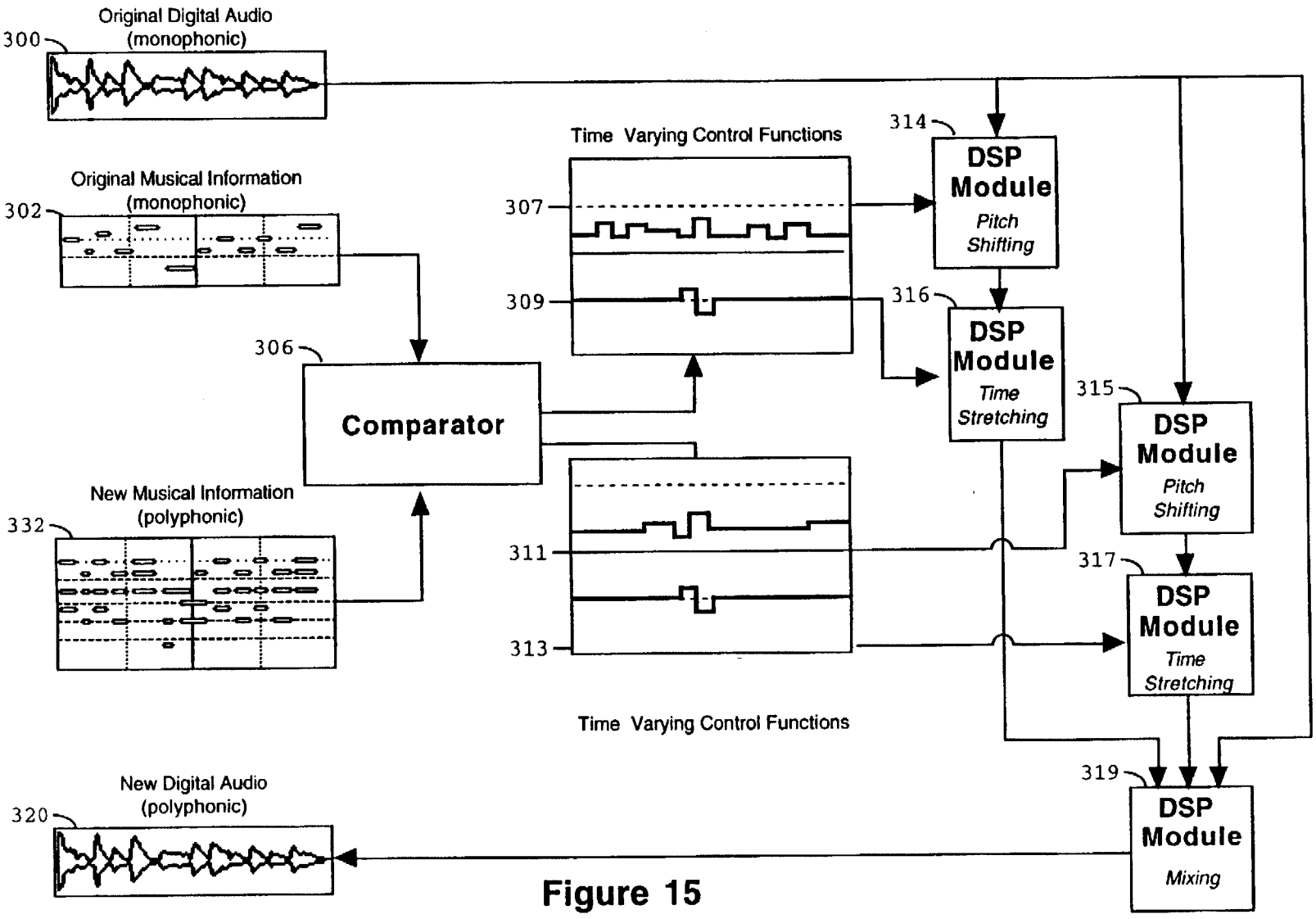

FIG. 15 is a block diagram showing the process of harmonizing musical parameters.

Figure 16:
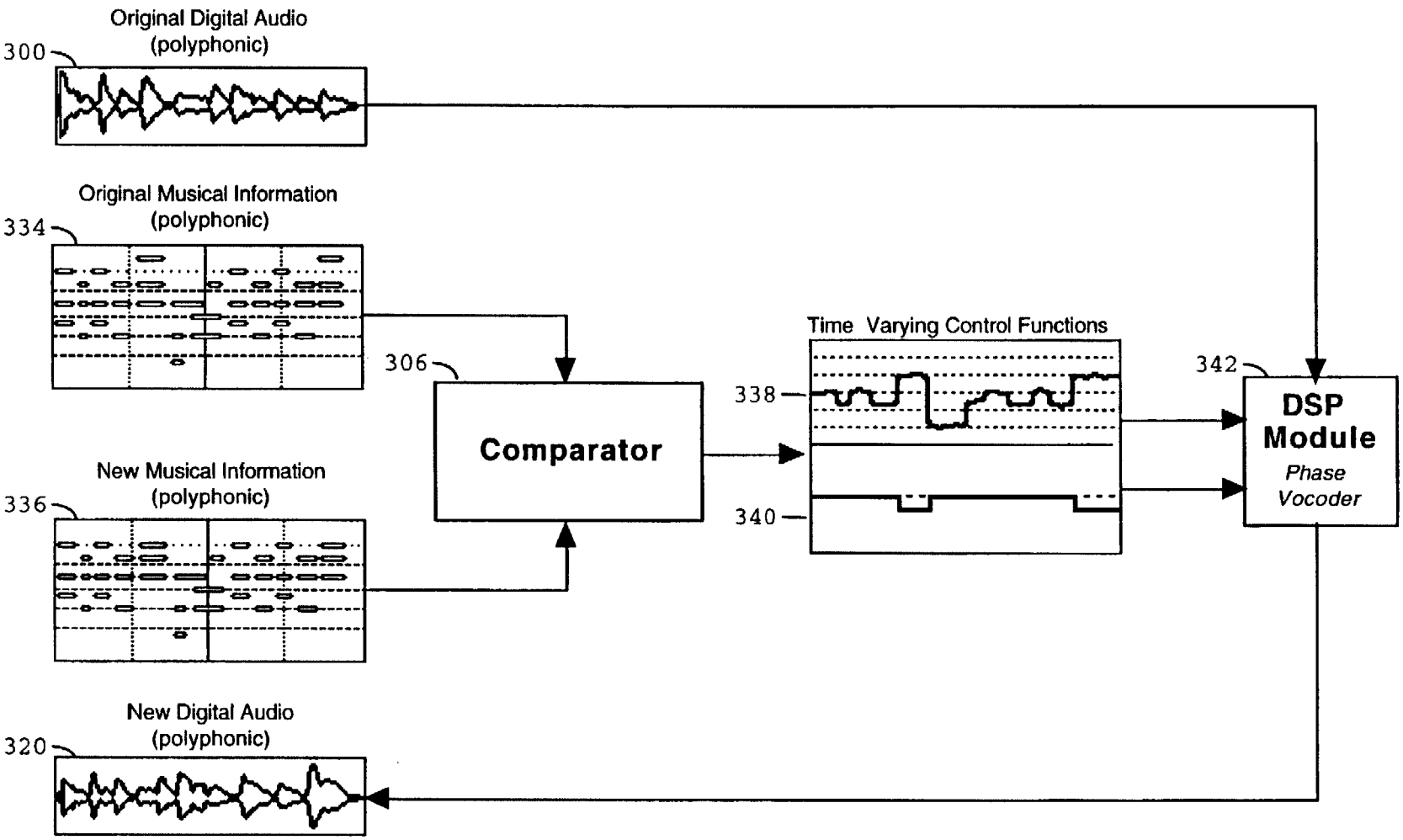

FIG. 16 is a block diagram showing the process of modifying polyphonic source material.

Figure 17:
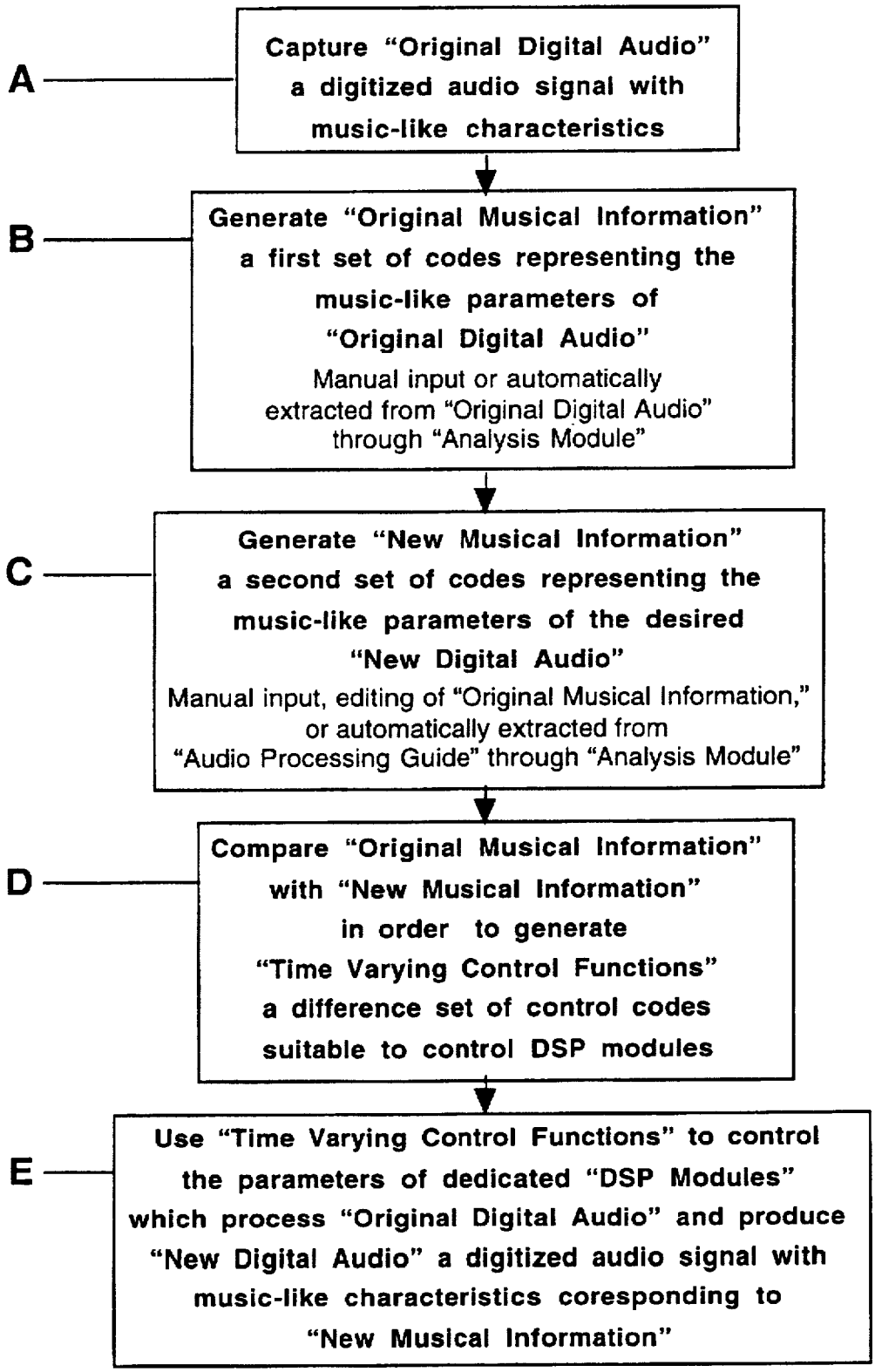

FIG. 17 is a general flow chart showing the process of the present invention.

DESCRIPTION OF SPECIFIC EMBODIMENTS

The present invention permits digital audio to be edited and enhanced with some of the flexibility already available in sequenced music. The method operates best on digital audio information having music-like characteristics such as pitch, timbre, cadence, time-dependent dynamics or like parameters that can be scored for subsequent reproduction. Voice and other audio signals often contain these music-like characteristics. In the context of music, the invention solves the long-standing problem of endless retakes by permitting minor flaws in recordings to be easily corrected. Many new creative musical possibilities may also be explored during production without requiring the original artists to be present.

Digital audio recordings can be represented in a form of notation that permits editing. The resulting edit changes are then applied to the audio recordings through digital signal processing techniques. A wide variety of parameters including pitch, timing, duration, loudness and timbre thus can be changed. The resulting edited sound may retain the nuance, timbre and ambiance of the original recording.

System Overview

In a preferred embodiment, the invention is implemented for Macintosh computers running a Mac Operating System Version 7. However, the present invention is not limited to any particular hardware or operating system environment. Instead, those skilled in the art will find that the systems and methods of the present invention may be advantageously applied to a variety of systems, including IBM compatible personal computers running MS-DOS, Microsoft Windows or workstations running UNIX as well as specialized music keyboards and music workstation products. Therefore, the following description of specific systems are for purposes of illustration and not limitation.

Figure 1:
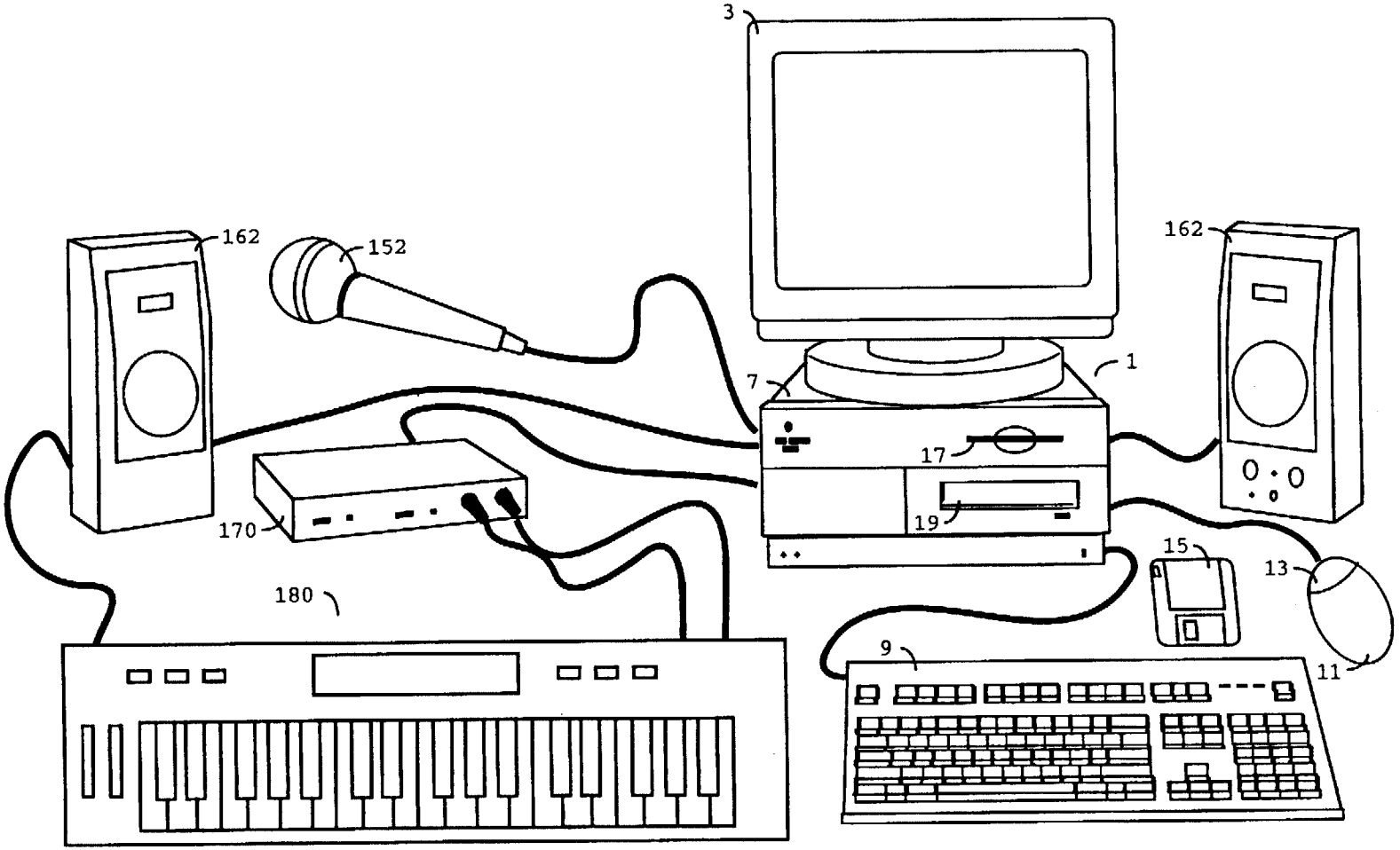
FIG. 1 illustrates an example of a computer system used to execute the software of the present invention.

FIG. 1 illustrates an example of a computer system used to execute the software of the present invention. FIG. 1 shows a computer system 1 which includes a monitor 3 with screen 5, cabinet 7, keyboard 9, and mouse 11. Mouse 11 may have one or more buttons such as mouse button 13. Cabinet 7 houses a floppy disk drive 17, CD-ROM drive 19, and a hard drive (not shown) that may be utilized to store and retrieve digital audio information and software programs incorporating the present invention. Although a floppy disk 15 is shown as the removable media, other removable tangible media including optical disk and tape may be utilized. Cabinet 7 also houses familiar computer components (not shown) such as a processor, memory, and the like. So far this is a typical desktop computer system.

In order to be able to handle sound and music, computer system 1 has a few extensions. Cabinet 7 houses Analog to Digital (A/D) and Digital to Analog (D/A) converters (not shown). Those may be built into the computer system or a third party sound card may be added. Microphone 152 connects to the A/D converters and provides a representative source of audio information. The D/A converters connect to amplified speakers 162. A MIDI interface 170 connects to a serial or other kind of I/O port of computer system 1 (I/O port not shown). A MIDI device 180, typically a keyboard/synthesizer, connects to the MIDI interface. The connection may be bi-directional; when one plays the MIDI keyboard, information about the performance is sent to the computer; the computer in turn can send MIDI codes to the synthesizer part of MIDI device 180. The sound output of MIDI device 180 connects to amplified speakers 162 where it is mixed with the sound output of the D/A converters; optionally a mixer can be used (not shown).

Figure 2:
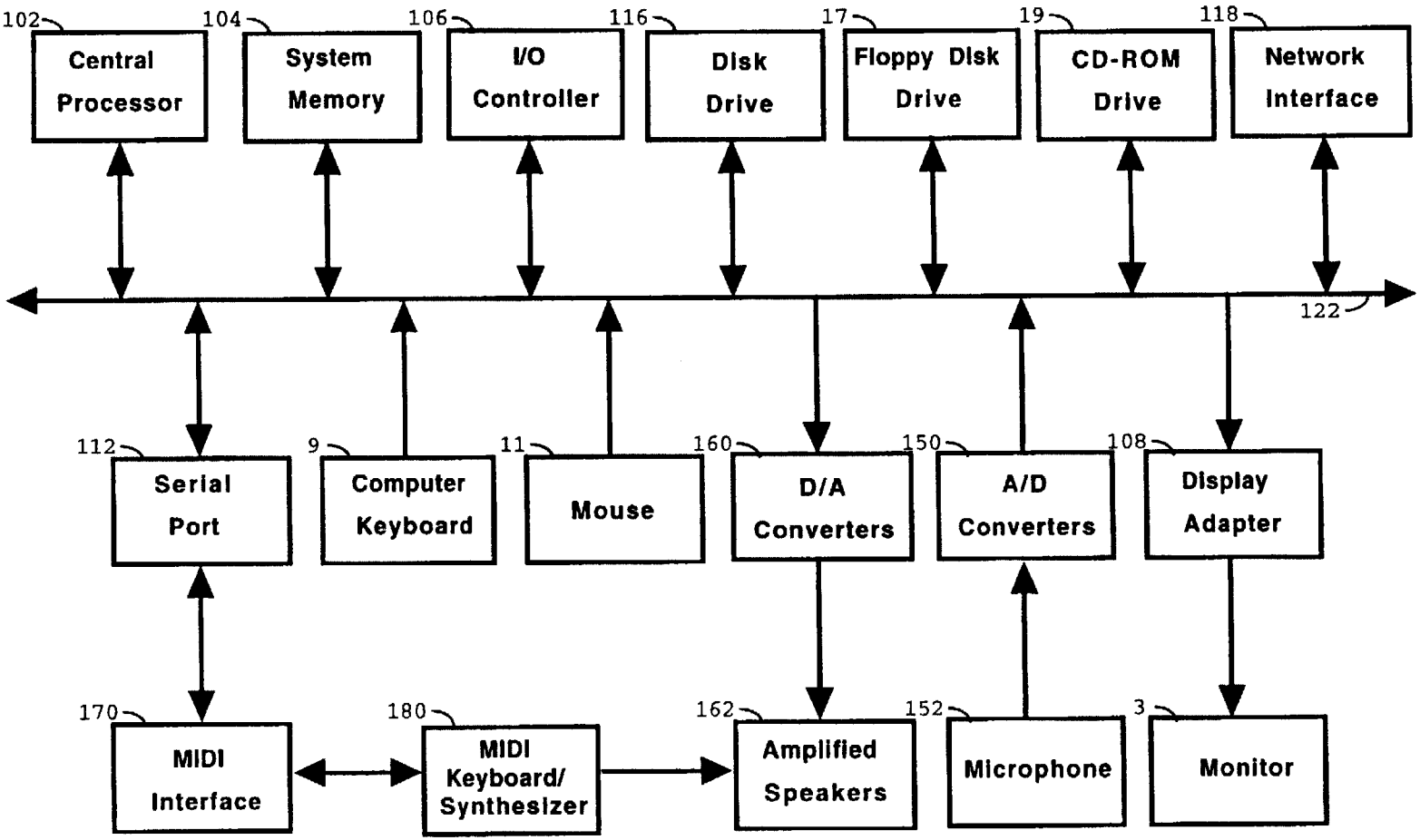
FIG. 2 shows a system block diagram of computer system 1 used to execute the software of the present invention.

FIG. 2 shows a system block diagram of the computer system used to execute the software of the present invention. As in FIG. 1, the computer system includes monitor 3, keyboard 9, mouse 11, floppy disk drive 17, and CD-ROM drive 19. The computer system further includes subsystems such as a central processor 102, system memory 104, I/O controller 106, display adapter 108, serial port 112, disk drive 116, network interface 118, analog to digital (A/D) converters 150, digital to analog (D/A) converters 160. Other extensions comprise microphone 152, amplified speakers 162, MIDI interface 170, and MIDI keyboard/synthesizer 180. Many of these subsystems are interconnected through system bus 122. Other computer systems suitable for use with the present invention may include additional or fewer subsystems. For example, another computer system could include more than one processor 102 (i.e., a multi-processor system) or memory cache.

Bi-directional arrows such as 122 represent the system bus architecture of the computer system. However, these arrows are illustrative of any interconnection scheme serving to link the subsystems. The computer system shown in FIG. 1 and FIG. 2 is but an example of a computer system suitable for use with the present invention. Other configurations of subsystems suitable for use with the present invention such as music workstations will be readily apparent to one of ordinary skill in the art.

In the preferred embodiment, A/D converters 150 can receive analog audio data from microphone 152 or other analog sound source, convert it to digital samples, and send those samples through bus 122 to system memory 104, disk drive 116, or other interface subsystems. D/A converters 160 convert digital samples received from system memory 104, disk drive 116, or other interface subsystems via bus 122, into analog sound data, then output the analog data to amplified speakers 162. MIDI interface 170 can (1) receive user input from the keyboard of MIDI device 180, and redirect the data through bus 122 to other sub-components of the system, and (2) receive data via bus 122 and output MIDI data to the synthesizer part of MIDI device 180. The analog output of keyboard/synthesizer 180 is amplified and output by amplified speakers 162.

Figure 3:
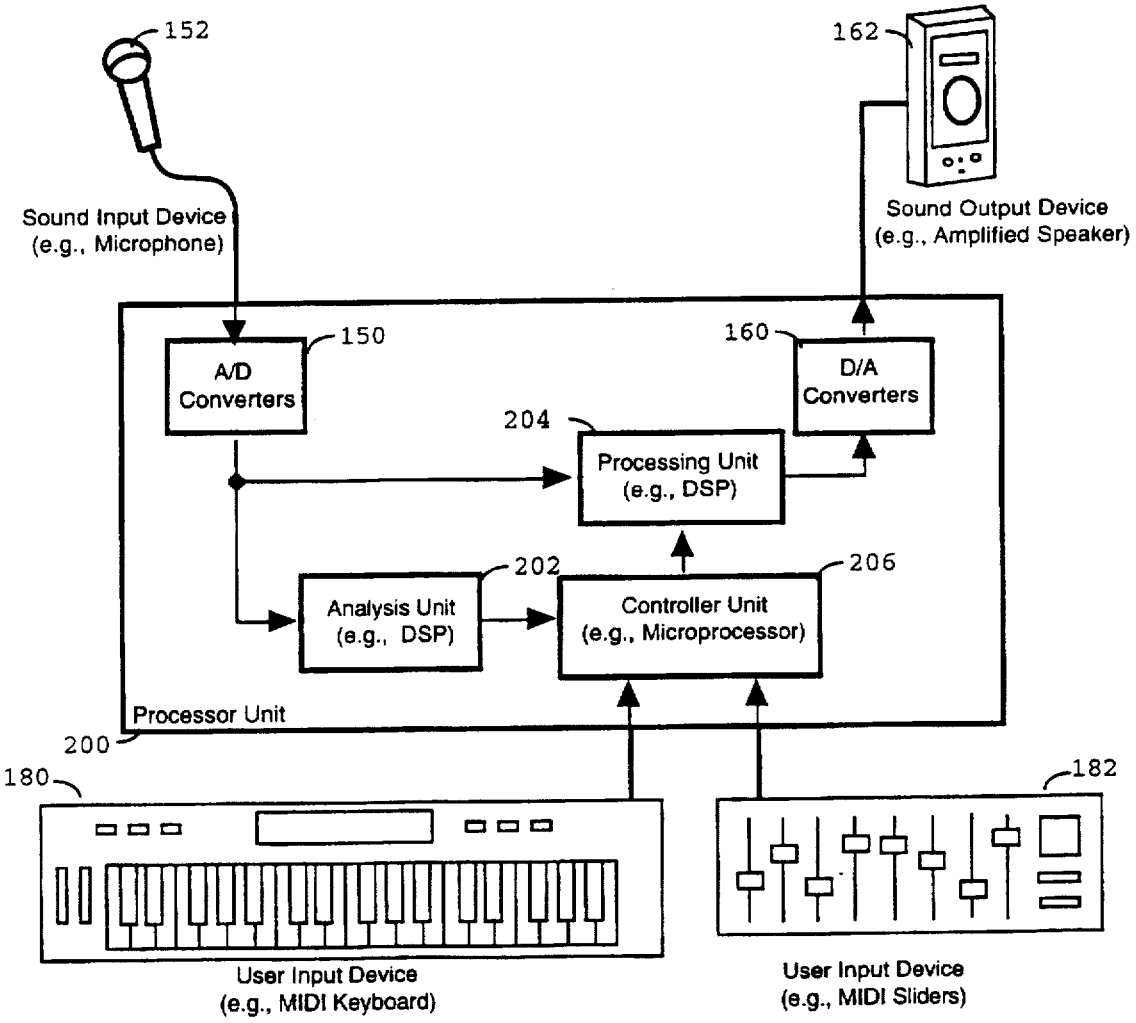
FIG. 3 shows a pictorial block diagram for an alternative real-time system used to implement the present invention.

FIG. 3 shows a block diagram for an alternative system used to execute the software of the present invention. In this embodiment, a keyboard/synthesizer or "music workstation" product is used to embody the present invention. Audio enters processor unit 200 from sound input device 152 (e.g., a microphone) and is converted into digital samples by A/D converters 150. Analysis unit 202 (e.g., DSP) extracts musical parameters from the converted digital samples. Notes and other musical parameters are also entered in real time from user input device 180 (e.g., a MIDI keyboard/synthesizer) and/or user input device 182 (e.g., MIDI sliders). Those notes and other parameters represent the user's musical intention.

Controller unit 206 (e.g., a microprocessor) compares the parameters generated by analysis unit 202 with the ones entered through user input device 180 and/or user input device 182 in real time. As a result of this comparison, time varying control functions for DSP algorithms are generated. The digitized samples from A/D converters 150 are also fed to processing unit 204 (e.g., DSP), which uses the time varying control functions generated by controller unit 206 as control parameters. The processing occurs in real time while all other components of the system continue to work in parallel. The resulting digital samples are converted to an analog signal by D/A converters 160. The analog signal is fed to sound output device 162 (e.g., an amplified speaker). The resulting sound retains many characteristics of the original sound like timbre, expression, and ambiance while some of its musical parameters (pitch, for instance) correspond to the parameters entered through input devices 180 and/or 182.

Processing unit 200 may be an independent unit housed in an enclosure with analog inputs and analog outputs as well as MIDI inputs and optionally MIDI outputs. Alternatively, processing unit 200 may be a subcomponent of a musical workstation housing MIDI keyboard 180 and optionally microphone 152 and amplified speakers 162 as well as processing unit 200 in one enclosure.

FIGS. 4*a*–4*f* illustrate various forms of musical representation. Musical parameters may be digitally stored in computer memory in many different ways. When presented to users, musical information takes one or more of various kinds of representations. FIG. 4*a* shows a short musical phrase in traditional music notation.

FIG. 4*b* shows the same phrase in piano roll representation—notes are represented as horizontal bars on a grid. Like traditional music notation, the horizontal axis represents time, while the vertical axis represents pitch. However, the length of a note is represented by the length of the bar while pitch is represented by the exact vertical position (no accidentals are used to alter the vertical position as in traditional music notation).

The same phrase is shown in FIG. 4*c* in a list representation. Each line represents a note with the first three columns delineating the start time, the fourth, fifth and sixth representing the duration, while the last two columns represent the velocities of pressing and releasing the corresponding key on a musical keyboard.

FIG. 4*d* shows a textual musical representation suitable for editing with a word processor. The different kinds of note representation in FIGS. 4*a*–4*d* are shown for illustration purposes only. Although traditional music notation, piano roll, and list representation are commonly used, other ways of representing music information may be equally suitable for displaying and editing musical parameters.

FIG. 4*e* and 4*f* represent methods for viewing and editing continuous MIDI controller data. Controller events are displayed as single vertical lines, indicating their values, along a horizontal axis, representing their placement in time. In addition to basic controller data (volume, pan, pitch bend), the Controller view may also be used for displaying and editing tempo events and key velocities for notes.

Figure 5A:
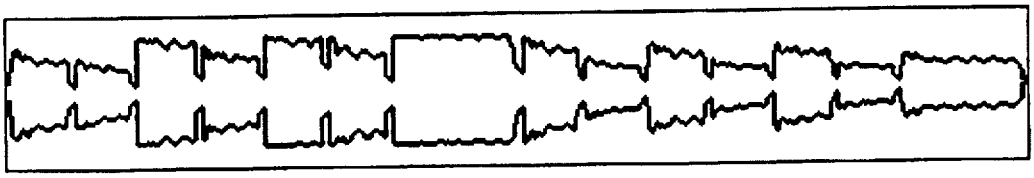
Figure 5B:
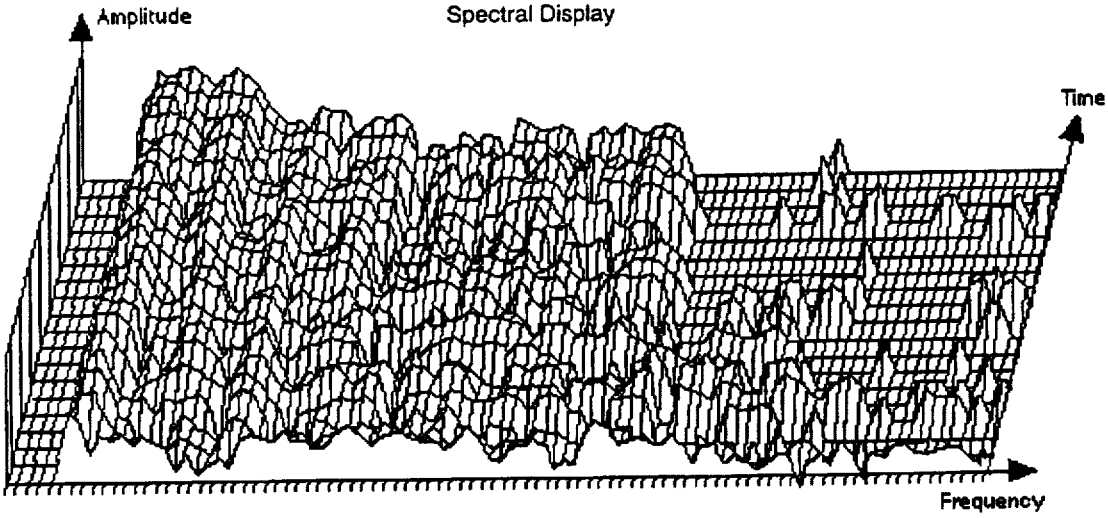
Figure 5C:
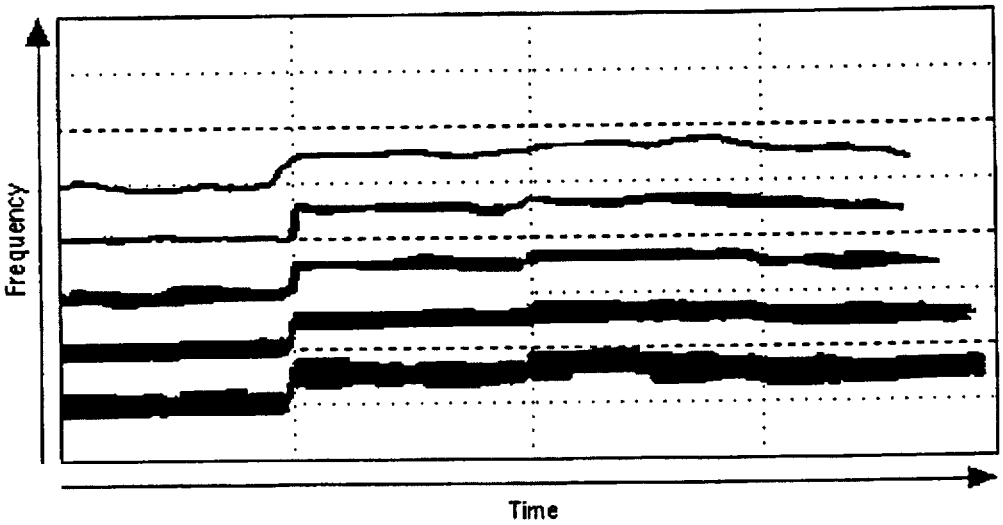

FIGS. 5*a*–5*c* show various representation of digital audio information. Digital samples are usually stored in memory or on hard disk drives as 16-bit two's-complement numbers. When presented to the user, digital sounds may take one or more of several kinds of representations.

FIG. 5*a* shows a waveform representation of a short digital audio fragment. The horizontal axis represents time while the vertical axis represents the amplitude of the samples. In this example the samples are very dense resulting in a dark shape that clearly shows how the energy of the sound changes in time. In some cases like the one in FIG. 5*a*, we can clearly see the shape of individual notes. However, it is nearly impossible to distinguish the pitch of the sound.

FIG. 5*b* shows a 3-D spectral representation of the sound. The sound is cut into small time slices (buffers), each slice is analyzed (usually using the Fourier transform), and an instantaneous spectral representation of that slice is generated. The x-axis represents frequency while the y-axis represents amplitude. Slices are arranged one after the other on the z-axis that represents time. This 3-D spectral representation allows us to see the evolution in time of each spectral component.

A different method of showing the evolution in time of the different spectral components, also known as partials or harmonics, is the sonogram, shown in FIG. 5*c*. The horizontal axis represents time, the vertical axis represents frequency. The amplitude of each spectral component is shown by the intensity of the color or gray, the darker the color the higher the amplitude. For black and white displays the width of the lines representing spectral components may show the amplitude.

As with music representation, the different ways of displaying digital audio information shown in FIGS. 5*a*–5*c* are for illustration purposes only. Other kinds of representation may be equally suitable for displaying and editing digital audio.

Definitions

Terminology for this patent application is defined below.

Attack: An attack is the sound of the beginning of a note. During the attack, which is often the loudest portion of a note, there are often brief percussive sounds that are not present later in the note. Attack sounds contribute greatly to an instrument's distinguishing characteristic.

Continuous controller: Some controllers generate signals that have a limited number of states (e.g., a foot switch). Continuous controllers, by contrast, generate a smooth, continuously varying function, to control sound characteristics such as volume, pan, or pitch bend.

Controller: A controller is a physical MIDI device that sends MIDI data to control a performance. Additionally, the term controller refers to the MIDI signal corresponding to a physical controller. Knobs and levers on keyboards, foot pedals and other devices send signals that can, for example, change the pitch of sound, introduce fluctuations in sound (called vibrato and tremolo), vary volume, or sustain notes longer than their normal length.

Controller view: This editing window provides an excellent method of viewing and editing continuous MIDI controller events. Controller events are displayed as single vertical lines, indicating their values, along a horizontal axis, representing their placement in time. Controller views for volume and pitch bend are illustrated in FIGS. 4*e* and 4*f*.

DSP: Digital signal processing (DSP) is the processing of a range of samples in a digital audio waveform. Common DSP algorithms add or change reverberation, echo, equalization, pitch, length, and the like. DSP algorithms can be executed on a computer's main processor or on a special DSP co-processor.

DSP module: A DSP module is a subprogram for performing a specific DSP function, such as pitch-shifting or time expansion or compression.

Duration: Duration is the length in time of a note. On an organ, for example, a note's duration is determined by how long its key is held down. A quarter note has twice the duration of an eighth note.

Dynamics: Dynamics are the variations in loudness of a passage of music.

Expression: Expression includes the variations in dynamics, timing and pitch that convey nuance and feeling in music.

Floating point samples: On compact discs, waveform samples consist of 16 bit integers. Floating point samples are represented with floating point numbers that consist of a group of digits and an exponent that determines where the decimal point is placed. The number 2.3459 E9 is a floating point number equivalent to 2,345,900,000, where the number following the "E" is the exponent. Floating point samples can represent a much wider dynamic range of sound volumes than integer samples.

List window and list view: One format for representing a musical performance consists of a list of notes in the order in which they are to be played. Musical parameters for each note are included in each list entry, such as the bar, beat and unit when the note is to begin, and its pitch, velocity and duration. Other formats include piano roll and standard musical notation. An example of list window/list view is illustrated in FIG. 4*c*.

Musical Instrument Digital Interface (MIDI): MIDI is a communications protocol that permits a wide variety of electronic music equipment (e.g., keyboards, electronic drums, synthesizers, computers and recording equipment) to communicate with each other. MIDI data includes performance data as opposed to sound or waveform data. It specifies which note (pitch) to play, when notes begin and end, how loud notes are to be played and the electronic instrument on which notes are to be played. MIDI does not describe the detailed sound of instruments.

Musical parameters: A musical performance can be represented as a collection of time-ordered notes, and the notes themselves represented with a set of numeric characteristics, known as musical parameters. Pitch, duration, attack and other "envelope" parameters, along with spectral content, are musical parameters.

Notation: Notation is the conventional way in which music is represented consisting of staves, key and time signatures, with notes represented as solid or empty heads with tails that have flags representing their lengths. Notation also uses special symbols for rests (periods of silence) and dynamics. An example of music notation is illustrated in FIG. 4*a*.

Piano roll: A piano roll display is a graphic representation of a region of music in which the Y-axis represents the pitch of a note and the X-axis represents time. The length of a note in piano roll format represents its duration. The format takes its name for the perforated paper rolls used in player pianos. An example of piano roll is illustrated in FIG. 4*b*.

Pitch: Pitch is the fundamental frequency of a note. As notes are played in an ascending scale, from left to right on a music keyboard, the pitch of each note is higher than the next. In addition to the fundamental frequency, notes contain higher frequency overtones that combine to give an instrument its characteristic timbre.

Pitch bend: Pitch bend is a continuous MIDI controller message that usually instructs an instrument to raise or lower the normal pitch of a note.

Playlist: Editing of digital audio by computer software is often done with playlists. With a playlist, original digital audio source material, stored as a collection of files, may be edited into a single composition without changing the content of the original files. Playlists are comprised of audio events, playing one after another and/or concurrently; audio events point to a specific region (with start and end points) of a particular source audio file. Audio events in a playlist may also contain volume and pan information to facilitate the process of creating a master mix.

Polyphony: Music in which two or more notes are playing at the same time is polyphonic. Sequences of notes to be played concurrently on separate instruments are called voices.

Quantization: In an actual musical performance by a human musician, there are variations in note timing, volume and pitch that may deviate from the intention of the composer. Quantization compares electronic codes generated from a human performance with an ideal performance and adjusts the coded values partially or completely in the direction of the ideal. Playing back the adjusted codes results in a more precise performance.

Spectral content: The content of a complex musical note may be represented as the sum of a series of simple sine waves of different frequencies, phases and amplitudes. The lowest, fundamental frequency is often the loudest and is the note's pitch. The unique blend of fundamental and higher frequencies, referred to as the note's spectral content, gives an instrument its distinguishing timbral characteristics. For example, "brightness" is caused by high frequency spectral content. The process of equalization modifies the overall spectral content of a passage of music.

Tempo map: A Tempo map is a representation of how the pace of a passage of music varies with time.

Text form: Another format for representing a musical performance consists of a list of musical parameters for each note (i.e., bar, beat, actual note, and note duration) in the order in which they are to be played. An example of text form is illustrated in FIG. 4*d*.

Velocity: When a note is played on a MIDI keyboard, the strength with which the key is struck is measured. When the note is then played, this measurement, known as velocity, can be used to control the note's initial loudness or other parameters.

Waveform: A waveform is a representation of an analog audio signal in which the Y-axis represents instantaneous amplitude and the X-axis represents time. An example of a waveform is illustrated in FIG. 5*a*.

Basic Principles of the Invention

FIG. 6 is a block diagram showing the basic principle of this invention. Original Digital Audio material 300 will be processed by DSP Modules 314, 316, and 318 resulting in New Digital Audio material 320. Certain music-like aspects of Original Digital Audio 300 will be modified while other parameters will stay the same. Some of the music-like parameters of Original Digital Audio 300 are coded and digitally stored as Original Musical Information 302. MIDI is one of many possible representation for this information. The New Musical Information 304 (again MIDI is one of many possible representations for this information) corresponds to the intended music-like parameters of New Digital Audio 320 after the modification.

We are attempting the transformation of the music-like parameters of "Original Digital Audio" 300, which are encoded by "Original Musical Information" 302 into new music-like parameters encoded by "New Musical Information" 304. We use Comparator 306 to find the differences between Original Musical Information 302 and New Musical Information 304, this operation being possible when Original Musical Information 302 and New Musical Information 304 have a structure suitable for comparison and encode similar music-like parameters. The output of Comparator 306 is the set of time varying control functions 308, 310, and 312. Any number of time varying control functions can be generated by comparator 306 depending on the number of similar music-like parameters encoded by Original Musical Information 302 and New Musical Information 304 as well as user preferences.

FIG. 6 suggests Original Musical Information 302 and New Musical Information 304 are encoded as MIDI and presented to the user in piano-roll and strip chart form. These are commonly used encoding and representation methods, however, many other encoding techniques and means of graphic representation may be used. FIG. 6 shows Original Musical Information 302 and New Musical Information 304 representing notes and volume changes. Notes are shown in piano roll form with pitch and duration as visible parameters while volume changes are represented as continuous controller events in strip chart form. Comparing the pitch of each note from Original Musical Information 302 with the pitch of each note from New Musical Information 304 results in Time Varying Control Function 308. Similarly, comparing durations from Original Musical Information 302 with durations from New Musical Information 304 results in Time Varying Control Function 310. The differences in volume changes from Original Musical Information 302 and New Musical Information 304 result in Time Varying Control Function 312.

Original Digital Audio 300 is processed by a set of Digital Audio Processing (DSP) Modules. FIG. 6 suggests three DSP Modules: 314, 316, and 318. However, any number of DSP Modules may be used depending on the number of time varying control functions generated by comparator 306 and user preferences. FIG. 6 suggests that the DSP Modules 314, 316, and 318 are connected in series, yet other configurations may be used.

Pitch Shifting DSP Module 314 processes Original Digital Audio 300 according to Time Varying Control Function 308. Pitches are raised, lowered or left unchanged in such a way that the pitches of the resulting output correspond now to the pitches encoded by New Musical Information 304. Time Stretching DSP Module 316 processes the output of Pitch Shifting DSP Module 314 according to Time Varying Control Function 310. Notes are lengthened, shortened, or left unchanged in such a way that the durations of the resulting output correspond to the duration encoded by New Musical Information 304. Similarly, Gain DSP Module 318 processes the output of Time Stretching DSP Module 316 according to Time Varying Control Function 312 the resulting output having volume changes corresponding to the volume changes encoded by New Musical Information 304.

The output of Gain DSP Module 318 is New Digital Audio 320 that contains all the transformations performed by DSP Modules 314, 316, and 318. The pitches, durations and volume changes of New Digital Audio 320 correspond now to the pitches, durations and volume changes encoded in New Musical Information 304. All other music-like and sonic parameters such as timbre, expression, and ambiance remain the same as in Original Digital Audio 300. Thus music-like parameters from our source material Original Digital Audio 300 have been modified according to the differences between Original Musical Information 302 and New Musical Information 304, resulting in new material New Digital Audio 320.

FIGS. 7, 8, 9, and 10 further illustrate the relationship between the Original Digital Audio (300 in FIG. 6), the Original Musical Information (302 in FIG. 6), the New Musical Information (304 in FIG. 6), the Time Varying Control Functions (308, 310, and 312 in FIG. 6), and the New Digital Audio (320 in FIG. 6). In FIG. 7 the Original Music Notation 301 and the Original Piano Roll 302 are two different methods of representation for the same Original Musical Information.

Underneath the Original Piano Roll 302 and aligned to it we see the Original Digital Audio 300 displayed as waveform. Original Digital Audio 300 has several music-like characteristics, note pitches and note durations being two of them. Those two attributes are coded in the Original Musical Information and displayed as Original Music Notation 301 and Original Piano Roll 302. Pitches are hard to identify in waveform display but individual notes may be apparent in some cases like the one we are examining here. The arrows 305 show the correspondence between the beginning of the second note, the fourth note, the sixth note, and so on, in the Original Piano Roll 302 and in the waveform display of Original Digital Audio 300.

In FIG. 8 the Original Musical Information has been replaced by New Musical Information represented as New Music Notation 303 and New Piano Roll 304. Since pitches are hard to identify in waveform display we are going to show only changes in the durations of the notes. We can see that the rhythm has been changed by comparing Original Music Notation 301 with New Music Notation 303 or Original Piano Roll 302 with New Piano Roll 304. Moreover the arrows 305 show that the beginning of the second note, the fourth note, the sixth note, and so on, in the waveform display of Original Digital Audio 300 and in the New Piano Roll 304 no longer correspond.

FIG. 9 shows the process of comparing Original Musical Information with New Musical Information in order to generate Time Varying Control Functions. In this example we are comparing only the durations from the Original Musical Information (represented in piano roll form as Original Durations 302) with the durations from the New Musical Information (represented in piano roll form as New Durations 304). The result is Time Varying Function 310 suitable to control a Time Stretching DSP Module (not shown).

The horizontal axis for Time Varying Control Function 310 represents the time of the Original Digital Audio (not shown in FIG. 9). The vertical axis represents the amount of time stretching; an amount smaller than 1 means time compression, an amount greater than 1 means time expansion, and an amount equal to 1 represents no change. As we can see the first, third, and fifth notes will be expanded to 1.5 times their original durations; the quarter notes become dotted quarter notes. The second, fourth, and sixth notes will be compressed to half their original durations; the quarter notes become eighth notes. The duration of the seventh note will not change. Similarly notes 8, 10, and 12 will be expanded, notes 9, 11, and 13 will be compressed, while note 14 will be left untouched.

The result of processing the Original Digital Audio 300 from FIG. 7 and FIG. 8 with a Time Stretching DSP Module (not shown) controlled by Time-Varying Control Function 310 from FIG. 9 is shown as New Digital Audio 320 in FIG. 10. New Music Notation 303 and New Piano Roll 304 are also shown. The arrows 305 accentuate the correspondence between the beginning of the second note, the fourth note, the sixth note, and so on, of the New Piano Roll 304 representation of the New Musical Information and the waveform representation of New Digital Audio 320.

We should emphasize how easy it is for a musician to understand the differences between the Original Musical Information and the New Musical Information as represented in either Traditional Music Notation or Piano Roll form. By contrast, we should note how unintuitive the Time-Varying Control Function 310 from FIG. 9 is. By letting the user express their desired changes in a familiar mode of representation and then electronically generating a time-varying function and supplying it as control input for an appropriate DSP Module, we provide for a much friendlier and more effective environment for the editing and transformation of recorded digital audio material.

Digital Audio Format

The digital audio used as source and as destination in the present invention (Original Digital Audio 300 and New Digital Audio 320 in FIG. 6) may be of any sample rate and any sample size. In professional settings, 16-bit two's-complement linear samples at 44.1 kHz or 48 kHz are commonly used. The digital audio may be stored on a hard disk, RAM, magneto-optical, CD-ROM, CD-Audio, or the like. Thus, any random access type of media may be used, even commercial CDs could be used although only as source material.

If the digital audio is stored on Digital Audio Tape or any other kind of linear media, time compression and expansion are hard to achieve. However, pitch shifting, gain change, filtering, and any kind of time invariant processing may equally be applied to digital audio on tape. Time compression and expansion are still possible if the tape deck's speed can be controlled.

When the digital audio is stored on hard disk or other non-volatile storage medium, any kind of file format may be used. For example, raw data files containing just the samples are usable. AIFF and Sound Designer II are popular sound file formats for the Apple Macintosh computers, while on Microsoft Windows, WAV files are widely used. All these and other file formats may be use to store the Original Digital Audio (300 in FIG. 6) and/or the New Digital Audio (320 in FIG. 6). Data compression is also viable as long as either (1) the DSP Modules can process compressed digital audio or (2) a decoder module is used to decompress the stored data before processing. In the second case an encoder module may be used to compress the result of processing. MPEG-Audio, Dolby's AC3, and AD-PCM are some of the many commonly used data compression methods applicable to this invention.

Floating point samples are also suitable if the DSP has floating point capabilities or if the data is converted before and/or after processing. Other encoding methods like μ-Law or a-Law may also be used.

Finally, analog audio may also be utilized. Analog audio may be digitized on the fly, and the rest of the processing will be identical to that of digital audio. Because the audio is not stored on disk, the same restrictions as those for digital tape apply. Moreover, the DSP Modules may be replaced by digitally controlled analog processing modules and then both the source material as well as the resulting new program can be analog audio. In the case where the analog processing modules are controlled by analog signals the digital time-varying control functions may be converted to analog signals before being fed to the processing modules.

Digital Audio Representation

Both Original Digital Audio (300 in FIG. 6) and New Digital Audio (320 in FIG. 6) may optionally have a visual representation. The most common display method for digital audio is the waveform (see FIG. 5*a*). Other options may include 3D spectral display (see FIG. 5*b*) and sonogram (see FIG. 5*c*) as well as any other method of graphical representation of digital audio.

Music-like and Other Audio Parameters

The content of the digital audio material may be music with such distinguishable elements and characteristics as notes, pitches, durations, rhythm, tempo, dynamics, accents, and the like. Sources other than music may be used especially when they exhibit music-like characteristics. For instance, speech may have cadence and intonation, while sound effects may have rhythm or dynamics. Any audio source with parameters that may be coded, modified, compared, and the differences used as time-varying parameters to control processing functions are suitable for use with this invention.

Some of the characteristics of the audio material may belong to common musical practice and may be represented by traditional musical notation. More generally, a parameter may be any kind of quantifiable sonic characteristic of the audio.

One important category is discrete parameters such as pitches (note names) and durations. Other characteristics such as loudness, tempo changes, or expression can also be expressed through discrete parameters such as dynamics markers (e.g., forte, piano, crescendo), tempo changes markers (e.g., accellerando, ritardando), or others such as accents (e.g., sforzando).

Some parameters may be viewed as continuous time varying functions. The way the fundamental pitch (or a series of fundamental pitches) varies in time may be represented by a continuous function. Loudness, brightness, rate and amount of tremolo, rate and amount of vibrato, amount of direct versus reverberated sound, 3-D location, as well as many other characteristics of the sound may be represented by continuous time varying functions. Continuous functions are also suitable for the representation of the characteristics of spoken words and other non-musical voice recordings.

Musical and Audio Parameters Codes

Discrete parameters may be coded in many different ways and stored in RAM or on permanent computer storage devices. Continuous time varying function may be represented and stored as sampled points, as connected line segments, or any other kind of approximation. Several languages and standards are available for digitally representing musical and sonic parameters. Most of those languages are suitable to encode the Original Musical Information (302 in FIG. 6) and the New Musical Information (304 in FIG. 6).

One of the most common encoding method is the MIDI standard. MIDI allows notes to be represented with pitch (note number), durations (interval between note "on" and note "off", or duration in MIDI files), and strength of the attack (velocity). Continuous pitch variations can be represented as Pitch Bend relative to the note's pitch. Continuous loudness variations can be represented as Volume controllers. Continuous brightness variations can be represented as any other MIDI controller. Other quantifiable parameters may be also represented as MIDI controllers. Other languages and standards may be suitable for use with this invention, but due to its prevalence and acceptance MIDI is the preferred choice.

Musical and Audio Parameters Representation

Both Original Musical Information (302 in FIG. 6) and New Musical Information (304 in FIG. 6) may optionally have a visual representation. The most common coding method for musical information in MIDI. Some of the most common ways of displaying MIDI are Traditional Music Notation (see FIG. 4*a*), Piano Roll (see FIG. 4*b*), and List (see FIG. 4*c*).

Time Varying Control Functions

The nature and number of Time Varying Control Functions (308, 310, and 312 in FIG. 6) depends on (1) the nature and number of similar parameters encoded into the Original Musical Information (302 in FIG. 6) and the New Musical Information (304 in FIG. 6) and (2) the number and kind of DSP Modules (314, 316, and 318 in FIG. 6). Time Varying Control Function may be represented and stored as sampled points, as connected line segments, or other kinds of mathematical description.

One of the goals of this invention is to provide musicians with familiar and intuitive tools. One way to achieve this goal is to insulate them from what may be perceived as complicated technical data and concepts such as Time Varying Control Functions. However, in some cases users may be given the option of graphically viewing and even editing the Time Varying Control Functions.

Not all musical parameters have a one-to-one correspondence with a Time Varying Control Function. In some cases comparing several sets of musical parameters may result in only one control function. In others, the differences between one pair of similar parameters may generate more than one control function.

For instance, comparing the duration of each note from Original Musical Information (302 in FIG. 6) with each note from New Musical Information (304 in FIG. 6) as well as comparing the duration of each silence from both sets of musical information, will result in a Time Varying Control Function suitable for controlling a Time Stretching DSP Module (see FIG. 9). Comparing tempo changes between the two sets of musical codes will also result in a Time Varying Control Function suitable for controlling a Time Stretching DSP Module. It is desirable to combine the two functions (by multiplying one with the other) in order to provided one single Time Varying Control Function. In this way we minimize the CPU requirements; multiplying two functions is less demanding than using two separate Time Stretching DSP Modules, one for duration changes, the other one for tempo changes.

Another similar example is the use of MIDI note numbers (discrete pitches) and pitch bend events (small continuous variations around each note) to code pitch variations. Comparing MIDI note numbers from Original Musical Information (302 in FIG. 6) with MIDI note numbers from New Musical Information (304 in FIG. 6) will result in one Time Varying Control Function suitable for controlling a Pitch Shifting DSP Module. Comparing pitch bend events from the two sets of codes will result in a similar Time Varying Control Function. The two may be combined into a single control function in order to minimize the CPU requirements. Thus the Comparator (306 in FIG. 6) may receive both note numbers and pitch bend events as input while its output may consist of a single control function.

Similarly, both the changes in the velocity of MIDI notes, a discrete parameter, and volume controller changes, a continuous parameter, represent variations in loudness. The Comparator may combine the two and output a single Time Varying Control Function suitable for controlling a Gain DSP Module. Furthermore, the amount and rate of tremolo may additionally affect loudness while the amount and rate of vibrato may add to the pitch variations.

On the other hand we may have one set of parameters generating several Time Varying Control Functions. For instance, the velocity of each MIDI note represents how fast (i.e. how hard) a key of a MIDI keyboard has been pressed. Velocity is first of all a gestural parameter that may translated into one or more sonic parameters in several ways. One commonly used technique is to use velocity to control both the loudness and the brightness of a note; the harder you hit a key the louder and brighter the resulting note. Thus comparing the velocity of each MIDI note from Original Musical Information (302 in FIG. 6) with the velocity of each MIDI note from New Musical Information (304 in FIG. 6) may result in two control functions, one suitable to control a Gain DSP Module, the other suitable to control a Filter DSP Module.

Translating Musical Codes Changes into Control Chances

In most cases changes in musical information translate easily into changes suitable to control a DSP Module. For instance, duration changes may be expressed as a ratio between the new duration and the old one (see FIG. 9). Thus a new duration that is twice as long as an old duration will be expressed as a ratio of 2 while a new duration that is half the duration of an old duration will be expressed as a ratio of 1/2 or 0.5. These ratios may be used directly to control a Time Stretching DSP Module.

Tempo changes are the inverse of duration changes. For instance, at a tempo of 60 beats per minute a quarter note is 1 second long; at a tempo of 120 beats per minute that is twice as fast, a quarter note is half a second long. Thus the time stretching ratio is the inverse of the tempo ratio. In order to control a Time Stretching DSP Module we need to take the old tempo and divide it by the new tempo, as opposed to dividing the new duration by the old duration. A time stretching ratio of 1 represents no change, a time stretching ratio greater than 1 represents time expansion, while a time stretching ratio less than 1 represents time compression. To combine two time stretching ratios we multiply the two fractions. Thus multiplying two or more time stretching control functions results in the combination of those functions.

Loudness changes may be exposed in dB or as a gain multiplier. The dB scale is logarithmic, thus a change of 0 dB means no change, a positive change means an increase in loudness, while a negative change represents a decrease in loudness. Combining two or more loudness functions expressed in dB is perform by adding the functions together. On the other hand a gain multiplier of 1 represents no change, a gain multiplier greater than 1 means an increase in loudness, while a gain multiplier less than 1 represents a decrease in loudness. Multiplying two or more gain control functions results in the combination of those functions. To translate between loudness changes, gain multiplier changes, and vice-versa we use the formulas:

$$L=20\log(g)$$

$$g=10^{L/20}$$

where L is the loudness change in dB and g is the gain multiplier.

Pitch changes may be expressed as musical intervals or as a frequency ratio. Musical intervals may be expressed as a number of semitones or in cents (one semitones has 100 cents). A positive number of semitones means shifting the pitch up for that number of semitones, a negative number means shifting the pitch down, while zero means no change. Combining pitch shifting functions expressed in musical intervals amounts to adding the functions. On the other hand a frequency ratio of 1 means no change, a frequency ratio greater than 1 means pitch shifting up, while a frequency ratio less than 1 means pitch shifting down. Multiplying two or more frequency ratio functions results in the combination of those functions. To translate between musical intervals, frequency ratios, and vice-versa we use the formulas:

$$s=12\log_2(f)$$

$$f=2^{s/12}$$

where s is the number of semitones and f is the frequency ratio.

DSP Modules

The structure and programming of DSP modules are dependent on the musical characteristics that are to be changed. To change the duration of timing of notes, rests, as well as tempo changes, a time searching module is employed. This module is able to compress or expand the timing without changing pitch. A pitch shifting DSP module can change the pitch of the subject without changing the timing. A gain module is used to change volume and dynamics. Filters may be used to alter the spectral content.

Automatic Extraction of Musical Parameters

In the basic process of the invention (FIG. 6), original musical information is entered manually. It can be very difficult to enter the desired nuances of a musical performance, therefore the computer may be used to extract this data from digital audio in a very precise mode. Hence, an enhancement to the invention is added.

As illustrated in FIG. 11, the Analysis Module 322 extracts musical information from original digital audio 300. Extracted musical information may be encoded in the form of MIDI data, including notes and continuous controller messages.

MIDI affords an intuitive and familiar environment for displaying and editing the extracted musical information: pitches and durations for individual notes with Notation and Piano Roll windows (FIGS. 4*a* and 4*b*), continuous controller data (such as volume, brightness and pitch bend) in Controller and List views (FIGS. 4*c*, 4*e*, and 4*f*).

Optionally, an Analysis Guide 324 may be used to control certain functions of the Analysis Module. For instance, the computer can generate continuous controller information in a very precise manner (better than the humans); however, it is easier for a human to decide whether a change in pitch, for example, should be treated as one note with much pitch bend or as several notes with less pitch bend. The Analysis Guide helps making such decisions. There may often be a repeated process of computer analysis, manual (human) editing of notes, more analysis, more editing, and so forth.

The rest of the procedure is the same as the basic process (FIG. 6). Extracted musical information 302 is an important reference for transforming the original digital audio source 300. New control codes 304, when compared to those from the original musical information 302, provide the necessary instructions to create new digital audio 320 via DSP modules (314, 316, 318).

Editing Musical Information

The basic process (FIG. 6) uses new musical information entered manually. Sometimes it is difficult to enter complicated continuous data. It is easier to edit the original information, especially when generated automatically from the Analysis Module (322 in FIG. 11). FIG. 12 illustrates how the original information 302 is transformed through the Editing Module 326, resulting in new musical information 304.

Editing Module 326 imposes changes on original musical information 302. These changes, representing new musical information 304, are compared to the original musical information 302 and the differences are then used as control input for processing by the appropriate DSP Module (314, 316, 318).

Once the musical information has been extracted into the domain of MIDI, there are numerous editing possibilities.

Pitches of individual notes or groups of notes are easily changed by manually dragging them (with the mouse) to new pitches in the Notation and Piano Roll (FIGS. 4*a* and 4*b*) windows. Flat and sharp pitches may be fixed by editing pitch bend data in the Controller view (FIG. 4*f*); articulations, often expressed as pitch fluctuations, may also be addressed with the appropriate drawing/editing tool in the Controller View (FIG. 4*f*). And, of course, entire phrases may be transposed-diatonically, modally, or with custom transposition maps. Changes in pitch are processed by the Pitch Shifting Module 314.

Individual note locations and lengths may also be changed manually in the Notation and Piano Roll (FIG. 4*a* and 4*b*) windows. Rhythmic placement of notes or phrases may be time corrected using a feature called Quantize. Tempo for original musical information is quite easily changed by inserting new tempo events in either List or Controller views; in fact, creating accelerandos and ritardandos is quite easy in the Controller view with the appropriate drawing tools. Changes with regards to time are processed by the Time Stretching Module 316.

Volumes of individual notes may be altered by editing their respective velocity values. Dynamics for groups of notes or phrases may be changed or scaled by drawing volume events (continuous controller 7) in the Controller view (FIG. 4*e*); in fact, producing crescendos and decrescendos is quite easy in the Controller view (FIG. 4*e*) with the appropriate drawing tools. Changes in amplitude are processed by the Gain Module 318.

The primary strength of this aspect of the invention is to offer new editing possibilities for digital audio. Although these editing capabilities are not new in and of themselves (they are commonly found in most MIDI sequencing software), they are however new to the application of digital audio editing.

Analysis and Editing (Studio Vision Pro 3.0)

The preferred embodiment of the invention is exemplified in Opcode's Studio Vision Pro (FIG. 13), and may be broken down into four phases: (1) Musical information is extracted from the original (monophonic) audio source and encoded in the form of MIDI data, (2) The desired edits are performed on the extracted musical information and is transformed into new musical information, (3) The new musical information is compared to the original musical information and the appropriate DSP control parameters are generated, (4) The differences between the original and new musical information provide the necessary control codes to transform the original audio into a new one.

Phase One

A monophonic digital audio file 300 is analyzed and its musical characteristics are extracted providing original musical information 302. For instance, a recording of a flute passage 300 is transformed into MIDI data 302 with individual notes indicating the basic melody, pitch-bend data reflecting the subtle articulations, and note velocities and volume data the phrasing and dynamics. Optionally, the extraction of musical information 302 may be assisted by the Analysis Guide 324.

Once these encoded control parameters are in the MIDI domain, they are intuitively displayed in the appropriate editing windows: notes in the Notation and Piano Roll windows (FIGS. 4*a* and 4*b*), continuous controller data in the Controller and List views (FIGS. 4*e* and 4*f*).

Phase Two

Altering a variety of aspects of the original musical information 302 is quite easy in the MIDI domain, which represents exciting possibilities for transforming recorded digital audio.

If the original flute recording 300 contains some flat or sharp notes, they can be smoothed out by editing or altering pitch bend data; if the key of the original performance is wrong, it can be transposed. If the dynamics of a particular section is not quite right, volume data can be added or changed to achieve the desired balance; and if tempo is determined to be too slow or fast, new tempos can be inserted.

Additionally, expressive aspects of the original performance 300 can be altered or enhanced. Phrasing can be changed from legato to staccato by editing individual note lengths; timing can become more strict or loose by using time correction routines (quantize); and, subtle crescendos and decrescendos can be added by ramping individual note velocities.

Phase Three

Once the desired edits are completed, the new edited musical information 304 is compared to the original musical information 302. The comparator 306 analyzes both sets of information and figures out their differences. Because the original musical information 302 is a direct link to characteristics of the original source audio, the control codes from the new musical information 304 can determine the necessary time varying control functions 308, 310, 312 to create the new audio file.

Phrase Four

Once the control changes for the appropriate DSP modules 314, 316, 318 are generated, a new digital audio file 320 is created by processing the original audio 300. Changes in pitch are processed by the Pitch Shifting module 314; changes in note lengths and tempo are processed by the Time Stretching module 316; and, changes in note velocities and volume data are processed by the Gain module 318.

An important aspect of the invention is that a new audio file 320 is created and the original source audio 300 need not be altered or deleted. Thus the technology represents "constructive" (not destructive) editing where the original material 300 is not lost. Optionally, the original audio 300 may be replaced by the new audio 320 if desired (to save hard disk space, for instance).

Using an Audio Guide to Generate New Musical Information

FIG. 14 illustrates a variation on the source for the new musical information 304 to which the original musical information 302 is compared. In previous examples, the new musical information 304 is derived from edited or existing MIDI data. In this variation of the invention, the source of the new musical material is from a second audio source file 328, which acts as a Processing Guide.

For instance, musical information is extracted from two separate and distinct audio files: the original 300 is a flute passage and the second 328 is a violin passage. The original flute passage 300 may have played all the correct pitches in more or less the right timing, however, the violin passage 328 may represent a more dynamic and articulate performance. Therefore, comparing the two sets of extracted musical information 302 and 304 can impose the desired aspects of violin's performance onto that of the flute's in a new digital audio file 320.

The remaining portions of this variation on the invention are the same as those in the basic process (FIG. 6).

Harmonizing

This variation of the invention seeks to harmonize monophonic digital audio 300. As FIG. 15 illustrates, original monophonic musical information 302 is compared to new polyphonic musical information 332; this comparison establishes pitch relationships between the two sources of musical information 300 and 332.

The new musical information 332 can introduce harmonic content far more advanced than basic, direct transpositions (major thirds, fifths, octaves, etc.). The new musical information 332 could provide harmonic content based on particular scales, modes and genres; in fact, the new material need not be based on the rhythmic content of the original digital audio 302, thereby providing the possibility of more advanced polyphonic counterpoint.

Once the Comparator 306 has determined the pitch relationships between the original and new musical information 302 and 332, it generates the time varying control functions 307, 309, 311, 313, which in turn provide the necessary instructions for the corresponding DSP modules 314–317.

FIG. 15 illustrates the Comparator 306 actually generating two new layers of harmonic content, which necessitates the addition of a new component in this variation of the experiment: the DSP Mixing Module 319. The DSP Mixing Module 319 mixes the original digital audio 300 with the new layers down to a new digital audio file 320.

The number of layers to be generated and mixed is determined by the Comparator 306 when comparing the original musical information 302 and new musical information 332. Additionally, if the original musical information 302 remains unchanged as a layer in the new musical information 332 then it need not be processed by the Pitch Shifting 314, 316 and Time Stretching 315, 317 modules; instead the original digital audio 300 is mixed with the new layers by the Mixing Module 319.

Modifying Polyphonic Source Material

FIG. 16 illustrates a variation on the invention that uses polyphonic material as the source for the original digital audio 300. The Comparator 306 examines the differences between original and new musical information 334, 336, both of which are polyphonic, and determines which voices are different.

If a particular voice is different, the comparator 306 isolates the voice in question (by fundamental pitch) and generates the necessary time varying functions 338 and 340 based on its pitch variations. This variation of the invention requires a new DSP Module called the Phase Vocoder 342, which is capable of analyzing and resynthesizing polyphonic material.

An important aspect of the Phase Vocoder 342 is its ability to analyze the time varying control functions 338 and 340 from the Comparator 306 and determine precisely how the material should be resynthesized. Any voice that the Comparator determines needs to be processed, is done so by the Phase Vocoder 342 without disturbing the other voices (which do not need processing). This is accomplished by only processing harmonics specific to the voice (identified by its fundamental pitch) that requires processing; harmonics from the other voices are not affected.

After the Phase Vocoder 342 has resynthesized the modified voices, a new polyphonic digital audio file 320 is generated.

The attached appendix contains select source code listings of elements of the invention.

The invention has now been explained with reference to specific embodiments. Other embodiments will be apparent to those of ordinary skill in the art. Therefore it is not intended that these claims be limited, except as indicated by the appended claims.

APPENDIX

SOURCE CODE LISTING EXCERPTS

```
#include <stdio.h>
#include <stdlib.h>
#include <string.h>
#include <math.h>
#include <time.h>
/*****************************************************************************
*
*                                Definitions
*
*****************************************************************************/
#define SAMPLE_RATE 44100
#define DURATION_IN_SECONDS 5
#define NUM_SAMPLES (SAMPLE_RATE * DURATION_IN_SECONDS / 100)
#define BEATS_PER_BAR 4
#define UNITS_PER_BEAT 480
#define TEMPO 120
#define PITCH_BEND_RANGE 2
#define SEMITONES_PER_BEND (4096.0 / PITCH_BEND_RANGE)
#define VOLUME_STEPS 127.0
#define DYNAMIC_RANGE 96.0
#define INPUT_FILE_NAME "audio.in"
#define OUTPUT_FILE_NAME "audio.out"
#define ENTER_ORIGINAL_PROMPT "Enter Original Musical Information:\n"
#define ENTER_NEW_PROMPT "Enter New Musical Information:\n"
/*************************************************************** ************
*
*                                Data Types
*
*************************************************************** ************/
typedef short AudioBuffer[NUM_SAMPLES];
typedef struct NoteEvent
{
    long   startTime;   /* in units */
    long   duration;    /* in units */
    short  noteNumber; /* 0 to 127 */
    short  velocity;   /* 0 to 127 */
    struct  NoteEvent *next;
} NoteEvent;
typedef struct PitchBendEvent
{
    long   startTime;   /* in units */
    short  pitchBend;   /* -8192 to 8191 */
    struct  PitchBendEvent *next;
} PitchBendEvent;
typedef struct VolumeEvent
{
    long   startTime;   /* in units */
    short  volume;      /* 0 to 127 */
    struct  VolumeEvent *next;
} VolumeEvent;
typedef struct MusicalInformation
{
    NoteEvent          *firstNoteEvent;
    PitchBendEvent     *firstpitchBendEvent;
    VolumeEvent        *firstVolumeEvent;
} MusicalInformation;
typedef struct ControlFunction
{
    long     startTime;      /* in samples */
    float    value;          /* type dependent */
    float    tempValue;      /* for intermediary results */
    struct   ControlFunction *next;
} ControlFunction;
/*************************************************************** ************
*
*                                Global Variables
*
*************************************************************** ************/
static AudioBuffer originalDigitalAudio;
static AudioBuffer intermidiateAudio_1;
```

APPENDIX-continued

SOURCE CODE LISTING EXCERPTS

```
static AudioBuffer intermidiateAudio_2;
static AudioBuffer newDigitalAudio;
static Boolean doExtractMusicalInformation = FALSE;
static Boolean doEditMusicalInformation = FALSE;
MusicalInformation *originalMusicalInformation;
MusicalInformation *newMusicalInformation;
ControlFunction *pitchControlFunction;
ControlFunction *gainControlFunction;
ControlFunction *timeControlFunction;
/************************************************************ ************
*
*                    Prototypes
*
************************************************************ ************/
void ReadAudioFile
    char *fileName,
    AudioBuffer input);
MusicalInformation *ExtractMusicFromAudio(
    AudioBuffer audio);
MusicalInformation *EditMusicalInformation(
    MusicalInformation *musicalInformation);
MusicalInformation *EnterMusicalInformation(
    char *prompt);
ControlFunction *FindPitchDifferences(
    MusicalInformation *originalMusicalInformation,
    MusicalInformation *newMusicalInformation);
ControlFunction *FindGainDifferences(
    MusicalInformation *originalMusicalInformation,
    MusicalInformation *newMusicalInformation);
ControlFunction *FindTimingDifferences(
    MusicalInformation *originalMusicalInformation,
    MusicalInformation *newMusicalInformation);
void PitchShiftAudio(
    ControlFunction *controlFunction,
    AudioBuffer input,
    AudioBuffer output);
void ChangeAudioGain(
    ControlFunction *controlFunction,
    AudioBuffer input,
    AudioBuffer output);
void TimeScaleAudio(
    ControlFunction *controlFunction,
    AudioBuffer input,
    AudioBuffer output);
void WriteAudioFile(
    char *fileName,
    AudioBuffer output);
/************************************************************ ************
*
*                    Implementation
*
************************************************************ ************/
void ReadAudioFile(
    char *fileName,
    AudioBuffer input)
{
    /*
     *      Implementation of this function is system dependent and
     *      straight-forward for someone of ordinary skill in the art.
     */
}
MusicalInformation *ExtractMusicFromAudio(
    AudioBuffer audio)
{
    /*
     *      Implementation of this function is system dependent and
     *      straight-forward for someone of ordinary skill in the art.
     */
}
MusicalInformation *EditMusicalInformation(
    MusicalInformation *musicalInformation)
{
    /*
     *      Implementation of this function is system dependent and
     *      straight-forward for someone of ordinary skill in the art.
     */
}
```

APPENDIX-continued

SOURCE CODE LISTING EXCERPTS

```
/*
 *      It is assumed that the user will input the notes, pitch bend, and volume
 *      events in ascending order and that there will be no duplicates.
 *      It is straight-forward for someone of ordinary skill in the art to add
 *      a sorting procedure and to remove duplicates.
 */
MusicalInformation *EnterMusicalInformation(
    char *prompt)
{
    MusicalInformation   *musicInfo;
    NoteEvent            *newNoteEvent ;
    PitchBendEvent       *newPitchBendEvent;
    VolumeEvent          *newVolumeEvent;
    NoteEvent            *lastNoteEvent;
    PitchBendEvent       *lastPitchBendEvent;
    VolumeEvent          *lastVolumeEvent;
    char      input[32];
    short     bar;
    short     beat;
    short     unit;
    short     noteNumber;
    short     velocity;
    short     pitchBend;
    short     volume;
/*
 *      Initialize
 */
newVolumeEvent = calloc(1, sizeof(VolumeEvent));
newVolumeEvent->startTime = 0;
newVolumeEvent->volume = 127;
newPitchBendEvent = calloc(1, sizeof(PitchBendEvent));
newpitchBendEvent->startTime = 0;
newPitchBendEvent->pitchBend = 0;
musicInfo = calloc(1, sizeof(MusicalInformation));
musicInfo->firstVolumeEvent = lastVolumeEvent = newVolumeEvent;
musicInfo->firstPitchBendEvent = lastPitchBendEvent = newPitchBendEvent;
printf("%s", prompt);
while (1)
{
    printf("\tEnter \ "Note,\" \"Volume,\" \"Bend,\" or \"End\"\n");
    scanf("%s", input);
    if (strcmp(input, "Note") == 0)
    {
        newNoteEvent = calloc(1, sizeof(NoteEvent));
        printf("\tEnter Start Time (bar, beat, unit) followed by \";\"\n");
        scanf("%d %d %d %s", &bar, &beat, &unit, input);
        newNoteEvent->startTime =     (bar - 1) * BEATS_PER_BAR * UNITS_PER_BEAT
                                      + (beat - 1) * UNITS_PER_BEAT
                                      + unit;
        printf("\tEnter Duration (beats, units) followed by \";\"\n");
        scanf("%d %d %s", &beat, &unit, input);
        newNoteEvent->duration=       beat * UNITS_PER_BEAT
                                      + unit;
        printf("\tEnter Note Number followed by \";\"\n");
        scanf("%d %s", &noteNumber, input);
        newNoteEvent->noteNumber = noteNumber;
        printf("\tEnter Velocity followed by \";\"\n");
        scanf("%d %s", &velocity, input);
         newNoteEvent->velocity = velocity;
        if (musicInfo->firstNoteEvent == NULL)
           musicInfo->firstNoteEvent = newNoteEvent;
        else
           lastNoteEvent->next = newNoteEvent;
        lastNoteEvent = newNoteEvent;
    }
    else if (strcmp(input, "Volume") == 0)
    {
        newVolumeEvent = calloc(1, sizeof (VolumeEvent));
        printf("\tEnter Start Time (bar, beat, unit) followed by \";\"\n");
        scanf("%d %d %d%s", &bar, &beat, &unit, input);
        newVolumeEvent->startTime =   (bar - 1) * BEATS_PER_BAR * UNITS_PER_BEAT
                                      + (beat - 1) * UNITS_PER_BEAT
                                      + unit;
        printf("\tEnter Volume followed by \";\"\n");
        scanf("%d %s", &volume, input);
        newVolumeEvent->volume = volume;
        lastVolumeEvent->next = newVolumeEvent;
```

APPENDIX-continued

SOURCE CODE LISTING EXCERPTS

```
        lastVolumeEvent = newVolumeEvent;
    }
    else if (strcmp(input, "Bend") == 0)
    {
        newPitchBendEvent = calloc(1, sizeof(PitchBendEvent));
        printf("\tEnter Start Time (bar, beat, unit) followed by \";\"\n");
        scanf("%d %d %d %s", &bar, &beat, &unit, input);
        newPitchBendEvent->startTime =   (bar - 1) * BEATS_PER_BAR * UNITS_PER_BEAT
                                         + (beat - 1) * UNITS_PER_BEAT
                                         + unit;
        printf("\tEnter Pitch Bend followed by \";\"\n");
        scanf("%d %s", &pitchBend, input)
        newPitchBendEvent->pitchBend = pitchBend;
        lastPitchBendEvent->next = newPitchBendEvent;
        lastPitchBendEvent = newPitchBendEvent;
    }
    else if (strcmp(input, "End") == 0)
        break;
    else
        printf("Error\n");
  }
  return musicInfo;
}
ControlFunction *FindPitchDifferences(
  MusicalInformation *originalMusicalInformation,
   MusicalInformation *newMusicalInformation)
{
  NoteEvent *originalNoteEvent;
  NoteEvent *newNoteEvent;
  PitchBendEvent * currentOriginalBend;
  PitchBendEvent *currentNewBend;
  ControlFunction *firstValue;
  ControlFunction *currentValue;
  ControlFunction *newValue;
  float seconds;
  float semitones;
  float bend;
  long currentTime;
  /*
   *      Start with notes and their note number.
   *      Start at the begining of both note lists.
   */
  firstValue = NULL;
  originalNoteEvent = originalMusicalInformation->firstNoteEvent;
  newNoteEvent = newMusicalInformation->firstNoteEvent;
  /*
   *      Stop when either list is exhausted.
   */
while (originalNoteEvent != NULL && newNoteEvent != NULL)
{
    /*
     *          Create a new point for the time-varying control function.
     *          Give it a time in units and a value that is the
     *          difference in semitones converted to frequency ratio.
     */
    newValue = calloc(1, sizeof(ControlFunction));
    newValue->startTime = originalNoteEvent->startTime;
    semitones = newNoteEvent->noteNumber - originalNoteEvent->noteNumber;
    newValue->value = semitones;
    /*
     *          Append the new point to the time-varying control function.
     */
    if (firstValue == NULL)
       firstValue = newValue;
    else
       currentValue->next = newValue;
    currentValue = newValue;
    /*
     *          Continue with the next pair of notes
     */
    originalNoteEvent = originalNoteEvent->next;
     newNoteEvent = newNoteEvent->next;
}
/*
 *      Now do the pitch bend. Start at the begining of both pitch bend lists.
 */
currentOriginalBend = originalMusicalInformation->firstPitchBendEvent;
```

APPENDIX-continued

SOURCE CODE LISTING EXCERPTS

```
currentNewBend = newMusicalInformation->firstPitchBendEvent;
/*
 *      We start at the beginning of the function.
 */
currentValue = firstValue;
currentTime = 0;
while (1)
{
    /*
     *          Check if we can use the current point.
     *          If not, we have to create a new one and insert it in the list.
     */
    if (currentValue->startTime == currentTime)
        newValue = currentValue;
    else
    {
        /*
         *          Create a new point and insert it in the list.
         */
        newValue = calloc(1, sizeof(ControlFunction));
        newValue->startTime = currentTime;
        if (newValue->startTime < firstValue->startTime)
        {
            newValue->value = 1.0;
            firstValue = newValue;
            newValue->next = currentValue;
            currentValue = newValue;
        }
        else
        {
            newvalue->value = currentValue->value;
            newvalue->next = currentvalue->next;
            currentValue->next = newValue;
            currentValue = newValue;
        }
    }
    /*
     *          Compute the difference between the original and the new pitch bend.
     *          Convert to semitomes and store it temporarily;
     */
    bend = currentNewBend->pitchBend - currentOriginalBend->pitchBend;
    newValue->tempValue = bend / SEMITONES_PER_BEND;
    /*
     *          Find the next time.
     *          Find the closest to current time from the three lists:
     *          1. The function resulted from comparing note numbers
     *             (currentValue->next),
     *          2. The original pitch bend (currentOriginalBend->next), and
     *          3. The new pitch bend (currentNewBend->next).
     */
    if (currentOriginalBend->next != NULL)
    {
        currentTime = currentOriginalBend->next->startTime;
        if (    currentNewBend->next != NULL
                && currentNewBend->next->startTime < currentTime)
            currentTime = currentNewBend->next->startTime;
        if (    currentValue->next != NULL
                && currentValue->next->startTime < currentTime)
            currentTime = currentValue->next->startTime;
    }
    else if (currentNewBend->next != NULL)
    {
        currentTime = currentNewBend->next->startTime;
        if (currentValue->next != NULL
            && currentValue->next->startTime < currentTime)
            currentTime = currentValue->next->startTime;
    }
    else if (currentValue->next != NULL)
    {
        currentTime = currentValue->next->startTime;
    }
    else
        break;
    /*
     *          Advance the pointers only for the lists that have an element
     *          whose start time matches the new found "currentTime"
     */
```

APPENDIX-continued

SOURCE CODE LISTING EXCERPTS

```
    if (    currentOriginalBend->next != NULL
            && currentOriginalBend->next->startTime == currentTime)
        currentOriginalBend = currentOriginalBend->next;
    if (    currentNewBend->next != NULL
            && currentNewBend->next->startTime == currentTime)
        currentNewBend = currentNewBend->next;
    if (    currentValue->next != NULL
            && currentValue->next->startTime == currentTime)
        currentValue = currentValue->next;
}
/*
 *      Go over the list one more time.
 */
currentValue = firstValue;
while (currentValue != NULL)
{
        /*
         *          Convert time in units to time in samples.
         */
        seconds = (currentValue->startTime / (float) UNITS_PER_BEAT) * (60.0 / TEMPO);
        currentValue->startTime = (long) (seconds * SAMPLE_RATE);
        /*
         *          Combine semitone differences from note numbers (value)
         *          with semitone differences from pitch bend (tempValue).
         *          Convert semitones to frequency ratio.
         */
        semitones = currentvalue->value + currentValue->tempValue;
        currentValue->value = pow(2, semitones / 12.0);
        currentValue = currentValue->next;
    }
    return firstValue;
}
ControlFunction *FindGainDifferences(
    MusicalInformation *originalMusicalInformation,
    MusicalInformation *newMusicalInformation)
{
    NoteEvent *originalNoteEvent;
    NoteEvent *newNoteEvent;
    VolumeEvent *currentOriginalVolume;
    VolumeEvent *currentNewVolume;
    ControlFunction *firstValue;
    ControlFunction *currentValue;
    ControlFunction *newValue;
    float seconds;
    float velocity;
    float volume;
    long currentTime;
    /*
     *          Start with notes and their velocity.
     *          Start at the begining of both note lists.
     */
    firstValue = NULL;
    originalNoteEvent = originalMusicalInformation->firstNoteEvent;
    newNoteEvent = newMusicalInformation->firstNoteEvent;
    /*
     *          Stop when either list is exhausted.
     */
    while (originalNoteEvent != NULL && newNoteEvent != NULL)
    {
        /*
         *          Create a new point for the time-varying control function.
         *          Give it a time in units and a value that is the
         *          difference between velocities converted to dB.
         */
        newValue = calloc(1, sizeof(ControlFunction));
        newValue->startTime = originalNoteEvent->startTime;
        velocity = newNoteEvent->velocity - originalNoteEvent->velocity;
        newValue->value = velocity / VOLUME_STEPS * DYNAMIC_RANGE;
        /*
         *          Append the new point to the time-varying control function.
         */
        if (firstValue == NULL)
            firstValue = newValue;
    else
        currentValue->next = newValue;
    currentValue = newValue;
    /*
```

APPENDIX-continued

SOURCE CODE LISTING EXCERPTS

```
     *          Continue with the next pair of notes
     */
    originalNoteEvent = originalNoteEvent->next;
    newNoteEvent = newNoteEvent->next;
}
/*
 *      Now do the volume events. Start at the begining of both volume lists.
 */
currentOriginalVolume = originalMusicalInformation->firstVolumeEvent;
currentNewVolume = newMusicalInformation->firstVolumeEvent;
/*
 *      We start at the beginning of the function.
 */
currentValue = firstValue;
currentTime = 0;
while (1)
{
    /*
     *          Check if we can use the current point.
     *          If not, we have to create a new one and insert it in the list.
     */
    if (currentValue->startTime == currentTime)
       newValue = currentValue;
    else
    {
        /*
         *          Create a new point and insert it in the list.
         */
        newValue = calloc(1, sizeof(ControlFunction));
        newValue->startTime = currentTime;
        if (newValue->startTime < firstValue->startTime)
        {
            newValue->value = 0.0;
            firstValue = newValue;
            newValue->next = currentValue;
            currentValue = newValue;
        }
        else
        {
            newValue->value = currentValue->value;
            newValue->next = currentValue->next;
            currentValue->next = newValue;
            currentValue = newValue;
        }
    }
    /*
     *          Compute the difference between the original and the new volume.
     *          Convert to dB store it temporarily;
     */
    volume = currentNewVolume->volume - currentOriginalVolume->volume;
    newValue->tempValue = volume / VOLUME_STEPS * DYNAMIC_RANGE;
    /*
     *          Find the next time.
     *          Find the closest to current time from the three lists:
     *          1. The function resulted from comparing note numbers
     *             (currentValue->next),
     *          2. The original volume (currentOriginalVolume->next), and
     *          3. The new volume (currentNewVolume->next).
     */
    if (currentOriginalVolume->next != NULL)
    {
        currentTime = currentOriginalVolume->next->startTime;
        if (    currentNewVolume->next != NULL\
                && currentNewVolume->next->startTime < currentTime)
           currentTime = currentNewVolume->next->startTime;
        if (    currentValue->next != NULL
                && currentValue->next->startTime < currentTime)
           currentTime = currentValue->next->startTime;
    }
    else if (currentNewVolume->next != NULL)
    {
        currentTime = currentNewVolume->next->startTime;
        if (currentValue->next != NULL
           && currentValue->next->startTime < currentTime)
           currentTime = currentValue->next->startTime;
    }
    else if (currentValue->next != NULL)
```

APPENDIX-continued

SOURCE CODE LISTING EXCERPTS

```
    {
        currentTime = currentValue->next->startTime;
    }
    else
        break;
    /*
     *          Advance the pointers only for the lists that have an element
     *          whose start time matches the new found "currentTime"
     */
    if (    currentOriginalVolume->next != NULL
            && currentOriginalVolume->next->startTime == currentTime)
        currentOriginalVolume = currentOriginalVolume->next;
    if (    currentNewVolume->next != NULL
            && currentNewVolume->next->startTime == currentTime)
        currentNewVolume = currentNewVolume->next;
    if (    currentValue->next != NULL
            && currentValue->next->startTime == currentTime)
        currentValue = currentValue->next;
}
/*
 *      Go over the list one more time.
 */
currentValue = firstValue;
while (currentValue != NULL)
{
    /*
     *          Convert time in units to time in samples.
     */
    seconds = (currentValue->startTime / (float) UNITS_PER_BEAT) * (60.0 / TEMPO);
    currentValue->startTime = (long) (seconds * SAMPLE_RATE);
    /*
     *          Combine velocity differences in dB (value)
     *          with volume defferences in dB (tempValue).
     *          Convert from dB to gain multiplyer
     */
    volume = currentValue->value + currentValue->tempValue;
    currentValue->value = pow(10, volume / 20.0);
    currentValue = currentValue->next;
  }
  return firstValue;
}
/*
 *      This routine compares only the duration od the notes.
 *      It is straight-forward for someone of ordinary skill in the art
 *      to compare the silences between notes too.
 */
ControlFunction *FindTimingDifferences(
    MusicalInformation *originalMusicalInformation,
    MusicalInformation *newMusicalInformation)
{
    NoteEvent *originalNoteEvent;
    NoteEvent *newNoteEvent;
    ControlFunction *firstValue;
    ControlFunction *currentValue;
    ControlFunction *newValue;
    float seconds;
    /*
     *          Start with notes and their durations.
     *          Start at the begining of both note lists.
     */
    firstValue = NULL;
    originalNoteEvent = originalMusicalInformation->firstNoteEvent;
    newNoteEvent = newMusicalInformation->firstNoteEvent;
    /*
     *          Stop when either list is exhausted.
     */
    while (originalNoteEvent != NULL && newNoteEvent != NULL)
    {
        /*
         *          Create a new point for the time-varying control function.
         *          Give it a time in units and a value that is the ratio
         *          between durations.
         */
        newValue = calloc(1, sizeof(ControlFunction));
        newValue->startTime = originalNoteEvent->startTime;
        newValue->value = (float) newNoteEvent->duration / originalNoteEvent->duration;
        /*
```

APPENDIX-continued

SOURCE CODE LISTING EXCERPTS

```
        *           Append the new point to the time-varying control function.
        */
        if (firstValue == NULL)
           firstValue = newValue;
        else
           currentValue->next = newValue;
        currentValue = newValue;
        /*
        *           Continue with the next pair of notes
        */
        originalNoteEvent = originalNoteEvent->next;
        newNoteEvent = newNoteEvent->next;
    }
    /*
    *           Go over the list one more time.
    */
    currentValue = firstValue;
    while (currentValue != NULL)
    {
        /*
        *           Convert time in units to time in samples.
        */
        seconds = (currentValue->startTime / (float) UNITS_PER_BEAT) * (60.0 / TEMPO);
        currentValue->startTime = (long) (seconds * SAMPLE_RATE);
        currentValue = currentValue->next;
    }
    return firstValue;
}
void PitchShiftAudio(
    ControlFunction *controlFunction,
    AudioBuffer input,
    AudioBuffer output)
{
    /*
    *           Implementation of this function is system dependent and
    *           straight-forward for someone of ordinary skill in the art.
    */
}
void ChangeAudioGain(
    ControlFunction *controFunction1,
    AudioBuffer input,
    AudioBuffer output)
{
    /*
    *           Implementation of this function is system dependent and
    *           straight-forward for someone of ordinary skill in the art.
    */
}
void TimeScaleAudio(
    ControlFunction *controlFunction,
    AudioBuffer input,
    AudioBuffer output)
{
    /*
    *           Implementation of this function is system dependent and
    *           straight-forward for someone of ordinary skill in the art.
    */
}
void WriteAudioFile(
    char *fileName,
    AudioBuffer output)
{
    /*
    *           Implementation of this function is system dependent and
    *           straight-forward for someone of ordinary skill in the art.
    */
}
void main(void)
{
    /*
    *           Phase 1
    *
    *           a. Aquire "Original Digital Audio."
    *           b. Extract "Original Musical Information" from "Oiginal Digital Audio"
    *              or Input "Original Musical Information."
    */
    ReadAudioFile(INPUT_FILE_NAME, originalDigitalAudio);
```

APPENDIX-continued

SOURCE CODE LISTING EXCERPTS

```
    if (doExtractMusicalInformation)
      originalMusicalInformation = ExtractMusicFromAudio (originalDigitalAudio);
    else
      originalMusicalInformation = EnterMusicalInformation(ENTER_ORIGINAL_PROMPT);
    /*
     *          Phase 2
     *
     *          Edit "Original Musical Information" into "New Musical Information"
     *            or Input "1New Musical Information."
     */
    if (doEditMusicalInformation)
      newMusicalInformation = EditMusicalInformation (originalMusicalInformation);
    else
      newMusicalInformation = EnterMusicalInformation(ENTER_NEW_PROMPT);
    /*
     *          Phase 3
     *
     *          Compare "Original Musical Information" and "New Musical Information"
     *            and generate "Time-Varying Control Function."
     */
    pitchControlFunction =
      FindPitchDifferences(originalMusicalInformation, newMusicalInformation);
    gainControlFunction =
      FindGainDifferences(originalMusicalInformation, newMusicalInformation);
    timeControlFunction =
      FindTimingDifferences(originalMusicalInformation, newMusicalInformation);
    /*
     *          Phase 4
     *
     *          Process "Original Digital Audio" according to "Time-Varying Control
     *          Functions" and output "New Digital Audio."
     */
    PitchShiftAudio(pitchControlFunction, originalDigitalAudio, intermidiateAudio_1);
    ChangeAudioGain(gainControlFunction, intermidiateAudio_1, intermidiateAudio_2);
    TimeScaleAudio(timeControlFunction, intermidiateAudio_2, newDigitalAudio);
    WriteAudioFile(OUTPUT_FILE_NAME, newDigitalAudio);
}
```

What is claimed is:

1. A method for obtaining a modified version of audio information having music-like characteristics comprising the steps of:

a) electronically storing a sequential series of time domain samples representing at least a portion of said audio information;

b) electronically storing a first set of codes corresponding to at least a first parameter representing said samples;

c) electronically storing a second set of codes having a data structure corresponding to said first set of codes in order to permit comparison between said second set of codes and said first set of codes; thereafter d) electronically comparing said first set of codes and said second set of codes to obtain at least one time varying sequence of differences to be used as a control function; and e) electronically processing said samples under control of said time varying control function according to at least one DSP function in order to obtain said modified version of said time domain samples containing characteristics of said second set of codes.

2. The method of claim 1 wherein said first set of codes and said second set of codes conform to the Musical Instrument Digital Interface (MIDI) standard.

3. The method of claim 1 further including the step of presenting a visual representation of said time varying control function to a user.

4. The method of claim 1 further including the prior step of editing said first set of codes to obtain said second set of codes.

5. The method of claim 1 wherein said audio information is music and wherein said first set of codes and said second set of codes are paired and wherein said first codes and said second codes comprise at least one of pitch, pitch bend, duration, tempo, volume, dynamic envelope and spectral content of a musical composition.

6. The method of claim 1 wherein said DSP functions include at least one of pitch shifting, time compression, time expansion, amplitude changes and spectral filtering.

7. The method of claim 6 wherein said audio information is polyphonic and wherein said DSP functions process at least one voice independently of other voices.

8. The method of claim 1 further including the prior step of compressing said time domain samples and wherein said storing step a) comprises storing compressed representation of said time domain samples and wherein said processing step further includes decompressing.

9. A method for obtaining a modified version of audio information having music-like characteristics comprising the steps of:

a) electronically storing a sequential series of time domain samples representing at least a portion of said audio information;

b) electronically storing a first set of codes corresponding to at least a first parameter representing said samples;

c) electronically storing a second set of codes having a data structure corresponding to said first set of codes in order to permit comparison between said second set of codes and said first set of codes; thereafter d) electronically comparing said first set of codes and said second set of codes to obtain at least one time varying control function; and e) electronically processing said samples under control of said time varying control function according to at least one DSP function in order to obtain said modified version of said time domain samples containing characteristics of said second set of codes;

wherein at least one of said first set of codes and said second set of codes is output for use in form of at least one of standard music notation, piano roll form, list form, text form and strip chart form.

10. A method for obtaining a modified version of audio information having music-like characteristics comprising the steps of:

a) electronically storing a sequential series of time domain samples representing at least a portion of said audio information;

b) electronically storing a first set of codes corresponding to at least a first parameter representing said samples;

c) electronically storing a second set of codes having a data structure corresponding to said first set of codes in order to permit comparison between said second set of codes and said first set of codes; thereafter d) electronically comparing said first set of codes and said second set of codes to obtain at least one time varying control function; and e) electronically processing said samples under control of said time varying control function according to at least one DSP function in order to obtain said modified version of said time domain samples containing characteristics of said second set of codes;

further including the prior step of quantizing said first set of codes to obtain said second set of codes is according to at least one user specified parameter.

11. A method for obtaining a modified version of audio information having music-like characteristics comprising the steps of:

a) electronically storing a sequential series of time domain samples representing at least a portion of said audio information:

b) electronically storing a first set of codes corresponding to at least a first parameter representing said samples;

c) electronically storing a second set of codes having a data structure corresponding to said first set of codes in order to permit comparison between said second set of codes and said first set of codes; thereafter d) electronically comparing said first set of codes and said second set of codes to obtain at least one time varying control function; and e) electronically processing said samples under control of said time varying control function according to at least one DSP function in order to obtain said modified version of said time domain samples containing characteristics of said second set of codes;

wherein said storing step a) comprises storing a playlist having events and wherein said electronically processing step e) is performed on at least one event in the playlist.

12. A method for obtaining a modified version of first audio information having music-like characteristics comprising the steps of:

a) electronically storing a first sequential series of time domain samples representing at least a portion of first said audio information;

b) electronically storing a first set of codes corresponding to at least a first parameter representing said first samples;

c) obtaining a second sequential series of time domain samples representing at least a portion of second audio information;

d) electronically storing said second set of codes corresponding to at least a one parameter representing said second samples and having a data structure corresponding to said first set of codes in order to permit comparison between said second set of codes and said first set of codes; thereafter e) electronically comparing said first set of codes and said second set of codes to obtain at least one time varying sequence of differences to be used as a control function; and f) electronically processing said samples under control of said time varying control function according to at least one DSP function in order to obtain said modified version of said time domain samples containing characteristics of said second samples.

13. A method for obtaining a modified version of original audio information having music-like characteristics comprising the steps of:

a) electronically storing, in any order:

a first series of time domain samples representing at least a portion of said original audio information, a first set of codes corresponding to at least a first time-varying parameter representing said first series of time domain samples, and a second set of codes corresponding to at least a first time-varying parameter of a desired modified version of said first series of time domain samples having a data structure comparable to said first set of codes;

b) electronically comparing said first set of codes and said second set of codes to obtain at least one time varying sequence of differences to be used as a control function;

c) providing said set of samples to at least one Digital Signal Processing (DSP) function;

d) providing said time varying control function to said DSP function; and e) altering said first series of time domain samples with said DSP function using said time varying control function in order to obtain a modified series of time domain samples containing characteristics of said second set of codes.

14. The method of claim 13 wherein said original audio information is music.

15. A method for obtaining a modified version of original audio information having music-like characteristics comprising the steps of:

a) electronically storing, in any order:

a first series of time domain samples representing at least a portion of said original audio information, a first set of codes corresponding to at least a first time-varying parameter representing said first series of time domain samples, and a second set of codes corresponding to at least a first time-varying parameter of a desired modified version of said first series of time domain samples having a data structure comparable to said first set of codes;

b) electronically comparing said first set of codes and said second set of codes to obtain at least one time varying control function;

c) providing said set of samples to at least one Digital Signal Processing (DSP) function;

d) providing said time varying control function to said DSP function; and e) altering said first series of time domain samples with said DSP function using said time varying control function in order to obtain a modified series of time domain samples containing characteristics of said second set of codes;

wherein:

a) said original audio information is monophonic and said first set of codes represents one voice, b) said desired modified version of original audio information is polyphonic and said second set of codes represents several voices, c) said comparing step b) includes comparing each of said voices of said second set of codes to said first set of codes to obtain two or more sets of time varying control functions, d) for each said set of time varying control functions, said step e) is performed where said first series of time domain samples is altered by said Digital Signal Processing using at least one time varying control function of said set of time varying control functions in order to obtain several modified series of time domain samples one for each said voice of said second set of codes, and e) said several modified series of time domain samples are mixed in order to obtain a harmonized version of said original audio information.

16. The method of claim 14 wherein said original audio information is polyphonic and wherein said DSP function alters at least one voice independently of other voices.

17. The method of claim 13 wherein said time-varying parameters comprise at least one of pitch, duration, loudness, brightness, tempo, fundamental frequency envelope, dynamics envelope, vibrato rate, vibrato depth, tremolo rate, tremolo depth, portamento, articulation, and spectral content of a musical composition.

18. The method of claim 13 wherein said original audio information is voice.

19. The method of claim 13 wherein at least one of said first set of codes and said second set of codes conform to the Musical Instrument Digital Interface (MIDI) standard.

20. The method of claim 13 wherein said first set of codes is obtained by electronically processing said first series of time domain samples according to at least one DSP analysis function.

21. The method of claim 20 further including the steps of:

a) electronically storing a third set of codes;

b) deriving from said third set of codes at least one time varying analysis control function; and c) providing said time varying analysis control function to said DSP analysis function.

22. The method of claim 21 wherein said third set of codes conforms to the Musical Instrument Digital Interface (MIDI) standard.

23. The method of claim 13 wherein said second set of codes is obtained by editing said first set of codes.

24. The method of claim 23 wherein said editing of said first set of codes is performed according to at least one of graphical editing, text editing, quantizing, and transposition.

25. The method of claim 13 wherein said second set of codes is derived by:

a) electronically storing a second series of time domain samples representing at least a portion of a second audio information; and b) electronically processing said second set of samples according to at least one analysis DSP function in order to obtain said second set of codes.

26. The method of claim 25 further including the step of presenting a visual representation of said second series of time domain samples in the form of at least waveform display, sonogram form, and spectrogram form.

27. The method of claim 13 wherein said DSP functions include at least one of pitch shifting, time compression and expansion, gain and spectral filtering.

28. The method of claim 13 wherein said first series of time domain samples are compressed according to a data compression method and wherein said DSP processing step e) further includes decompressing said first series of time domain samples.

29. The method of claim 13 further including compressing said modified series of time domain samples according to a data compression method.

30. A method for obtaining a modified version of original audio information having music-like characteristics comprising the steps of:

a) electronically storing, in any order:

a first series of time domain samples representing at least a portion of said original audio information, a first set of codes corresponding to at least a first time-varying parameter representing said first series of time domain samples, and a second set of codes corresponding to at least a first time-varying parameter of a desired modified version of said first series of time domain samples having a data structure comparable to said first set of codes;

b) electronically comparing said first set of codes and said second set of codes to obtain at least one time varying control function;

c) providing said set of samples to at least one Digital Signal Processing (DSP) function;

d) providing said time varying control function to said DSP function; and e) altering said first series of time domain samples with said DSP function using said time varying control function in order to obtain a modified series of time domain samples containing characteristics of said second set of codes;

wherein said first series of time domain samples is electronically stored as a first file on computer permanent storage and wherein said modified series of time domain samples is electronically stored as a file on computer permanent storage according to one of two methods:

a) in a second file separate from said first file; and b) in said first file in order for said modified version of original audio information to replace said original audio information.

31. A method for obtaining a modified version of original audio information having music-like characteristics comprising the steps of:

a) electronically storing, in any order:

a first series of time domain samples representing at least a portion of said original audio information, a first set of codes corresponding to at least a first time-varying parameter representing said first series of time domain samples, and a second set of codes corresponding to at least a first time-varying parameter of a desired modified version of said first series of time domain samples having a data structure comparable to said first set of codes;

b) electronically comparing said first set of codes and said second set of codes to obtain at least one time varying control function;

c) providing said set of samples to at least one Digital Signal Processing (DSP) function;

d) providing said time varying control function to said DSP function; and e) altering said first series of time domain samples with said DSP function using said time varying control function in order to obtain a modified series of time domain samples containing characteristics of said second set of codes;

wherein said first series of time domain samples are derived from a playlist.

32. A method for obtaining a modified version of original audio information having music-like characteristics comprising the steps of:

a) electronically storing, in any order:

a first series of time domain samples representing at least a portion of said original audio information, a first set of codes corresponding to at least a first time-varying parameter representing said first series of time domain samples, and a second set of codes corresponding to at least a first time-varying parameter of a desired modified version of said first series of time domain samples having a data structure comparable to said first set of codes;

b) electronically comparing said first set of codes and said second set of codes to obtain at least one time varying control function;

c) providing said set of samples to at least one Digital Signal Processing (DSP) function;

d) providing said time varying control function to said DSP function; and e) altering said first series of time domain samples with said DSP function using said time varying control function in order to obtain a modified series of time domain samples containing characteristics of said second set of codes;

wherein at least one of said first series of time domain samples, said first set of codes, said second set of codes, said time varying control functions, and said modified series of time domain samples is displayed to a user of the system implementing said method.

33. The method of claim 32 wherein at least one of said first series of time domain samples and of said modified series of time domain samples is displayed in the form of at least one of waveform display, sonogram form, and spectrogram form.

34. The method of claim 32 wherein at least one of said first set of codes and of said second set of codes is displayed in the form of at least one of standard music notation form, piano roll form, list form, text form and strip chart form.

35. A method for obtaining a modified version of original audio information having music-like characteristics comprising the steps of:

a) electronically storing, in any order:

a first series of time domain samples representing at least a portion of said original audio information, a first set of codes corresponding to at least a first time-varying parameter representing said first series of time domain samples, and a second set of codes corresponding to at least a first time-varying parameter of a desired modified version of said first series of time domain samples having a data structure comparable to said first set of codes;

b) electronically comparing said first set of codes and said second set of codes to obtain at least one time varying control function;

c) providing said set of samples to at least one Digital Signal Processing (DSP) function;

d) providing said time varying control function to said DSP function; and e) altering said first series of time domain samples with said DSP function using said time varying control function in order to obtain a modified series of time domain samples containing characteristics of said second set of codes;

wherein said first set of codes is obtained by electronically processing said first series of time domain samples according to at least one DSP analysis function;

further including the steps of:

a) electronically storing a third set of codes;

b) deriving from said third set of codes at least one time varying analysis control function; and c) providing said time varying analysis control function to said DSP analysis function;

wherein said third set of codes conforms to the Musical Instrument Digital Interface (MIDI) standard; and wherein said third set of codes is displayed in the form of at least one of standard music notation form, piano roll form, list form, text form and strip chart form.

* * * * *